US008425017B2

(12) United States Patent
Katada

(10) Patent No.: US 8,425,017 B2
(45) Date of Patent: Apr. 23, 2013

(54) LIQUID DROPLET EJECTING APPARATUS AND METHOD OF CONTROLLING LIQUID DROPLET EJECTING APPARATUS

(75) Inventors: Masahito Katada, Ashigarakami-gun (JP); Yuko Katada, legal representative, Ebina (JP); Natsuki Katada, legal representative, Ebina (JP); Daichi Katada, legal representative, Ebina (JP)

(73) Assignee: FUJIFILM Corporation, Tokyo (JP)

( * ) Notice: Subject to any disclaimer, the term of this patent is extended or adjusted under 35 U.S.C. 154(b) by 630 days.

(21) Appl. No.: 12/561,317

(22) Filed: Sep. 17, 2009

(65) Prior Publication Data

US 2010/0079562 A1 Apr. 1, 2010

(30) Foreign Application Priority Data

Sep. 30, 2008 (JP) ..... 2008-254625

(51) Int. Cl.
*B41J 2/175* (2006.01)
*B41J 29/38* (2006.01)

(52) U.S. Cl.
USPC ..... 347/85; 347/6; 347/86

(58) Field of Classification Search ..... 347/6, 84, 347/85, 86
See application file for complete search history.

(56) References Cited

U.S. PATENT DOCUMENTS

2008/0198207 A1* 8/2008 Katada ..... 347/85
2008/0231650 A1* 9/2008 Kojima et al. ..... 347/17

FOREIGN PATENT DOCUMENTS

JP 2007-223278 A 9/2007

* cited by examiner

*Primary Examiner* — Jannelle M Lebron
(74) *Attorney, Agent, or Firm* — SOLARIS Intellectual Property Group, PLLC

(57) ABSTRACT

A liquid droplet ejecting apparatus includes: a supply-use tank that is sectioned by an elastic film into a liquid chamber and a gas chamber; a supply-use flow path that interconnects the supply-use tank and a recording head; and a pump that pumps the liquid stored in the liquid chamber to the recording head via the supply-use flow path by supplying the liquid from an external tank to the liquid chamber of the supply-use tank. The flow path is controlled to supply the liquid to the liquid chamber in a state where the supply-use flow path is closed, cause the elastic film to press against an inner wall of the gas chamber, thereafter open the supply-use flow path, release the elastic film from the pressing state, and supply, with the pump, the liquid from the external tank to the recording head via the supply-use tank and the supply-use flow path.

15 Claims, 14 Drawing Sheets

LIQUID DROPLET EJECTING APPARATUS AND METHOD OF CONTROLLING LIQUID DROPLET EJECTING APPARATUS

CROSS-REFERENCE TO RELATED APPLICATION

This application claims priority under 35 USC 119 from Japanese Patent Application No. 2008-254625 filed on Sep. 30, 2008, the disclosure of which is incorporated by reference herein.

BACKGROUND OF THE INVENTION

1. Field of the Invention

The present invention relates to a liquid droplet ejecting apparatus and a method of controlling the liquid droplet ejecting apparatus.

2. Description of the Related Art

Conventionally, liquid droplet ejecting apparatus that eject ink droplets from nozzles of an inkjet recording head (also called a "recording head" below) to record an image on a recording medium such as recording paper have been known. Usually, the ink is supplied to the recording head via a supply-use flow path from an ink tank in which the ink is stored.

Contaminants such as dirt and dust that become mixed into the ink and air bubbles that form in the ink cause ejection defects and increase flow path resistance, and removing air bubbles and contaminants included in the ink is important for maintaining printing quality.

As an inkjet recording apparatus that includes the function of removing air bubbles and contaminants included in the ink, in Japanese Patent Application Laid-Open Publication (JP-A) No. 2007-223278, there is disclosed an inkjet recording apparatus comprising an ink tank that stores an ink, a pump that pumps the ink stored in the ink tank to a recording head, an intermediate tank that is disposed between the pump and the recording head and includes a flexible bag that stores the ink that has been pumped by the pump, an ink flow path that bypasses the intermediate tank, a plurality of valves that are disposed upstream and downstream of the intermediate tank and in the ink flow path, and a control unit that performs control to open and close the plurality of valves such that the ink is supplied through the intermediate tank or the ink flow path.

However, in the technology disclosed in JP-A No. 2007-223278, there has been the problem that, in the ink supply system that includes the intermediate tank, when the flow path that is communicated with the recording head is pressurized, air bubbles and contaminants included in the ink inside the flow path cannot be sufficiently discharged from the nozzles because, as indicated by graph A in FIG. 13, the pressure acting on the recording head cannot be quickly raised. Further, there has also been the problem that, in the ink supply system including the ink flow path that does not use the intermediate tank, when the flow path that is communicated with the recording head is pressurized, even though the pressure acting on the recording head can be quickly raised, as indicated by graph B in FIG. 13, the pressure quickly falls immediately thereafter, so the flow velocity of the ink inside the flow path is not stable, and air bubbles and contaminants included in the ink inside the flow path cannot be sufficiently discharged from the nozzles.

SUMMARY OF THE INVENTION

The present invention has been made in order to address these problems and provides a liquid droplet ejecting apparatus that can improve the ability of a liquid droplet ejecting apparatus to discharge air bubbles and contaminants included in a liquid for image recording.

A liquid droplet ejecting apparatus of a first aspect of the present invention includes: a recording head that ejects liquid droplets onto a recording medium to record an image; a supply-use tank whose inside is sectioned by a first elastic film capable of elastic deformation into a liquid chamber that stores a liquid for image recording to be supplied to the recording head and a gas chamber that is filled with a gas; a supply-use flow path that is capable of being opened and closed and interconnects the supply-use tank and the recording head such that the liquid is capable of circulating therethrough; a first pump that pumps the liquid stored in the liquid chamber of the supply-use tank to the recording head via the supply-use flow path that has been opened by supplying the liquid from an external tank in which the liquid is stored to the liquid chamber of the supply-use tank; and a control unit that controls of the flow path to supply the liquid to the liquid chamber such that the liquid chamber is filled with the liquid in a state where the supply-use flow path is closed, hold the first elastic film in a state where the first elastic film is caused to press against an inner wall of the gas chamber, thereafter open the supply-use flow path to cause the first elastic film to move from the state where the elastic film is caused to press against the inner wall of the gas chamber to a state where pressing is released, and supply, with the first pump, the liquid from the external tank to the recording head via the supply-use tank and the supply-use flow path.

According to the liquid droplet ejecting apparatus of the first aspect of the present invention, the recording head ejects liquid droplets onto the recording medium to record an image, the inside of the supply-use tank is sectioned by the first elastic film capable of elastic deformation into the liquid chamber that stores a liquid for image recording that the supply-use tank supplies to the recording head and the gas chamber that is filled with a gas, the supply-use flow path capable of being opened and closed interconnects the supply-use tank and the recording head such that the liquid is capable of circulating therethrough, and the first pump pumps the liquid stored in the liquid chamber of the supply-use tank to the recording head via the supply-use flow path that has been opened by supplying the liquid from the external tank in which the liquid is stored to the liquid chamber of the supply-use tank.

Additionally, in the present invention, the control unit performs control to supply the liquid to the liquid chamber such that the liquid chamber is filled with the liquid in a state where the supply-use flow path is closed, hold the first elastic film in a state where the first elastic film is caused to press against the inner wall of the gas chamber, thereafter open the supply-use flow path to cause the first elastic film to move from the state where the elastic film is caused to press against the inner wall of the gas chamber to a state where pressing is released, and supply, with the first pump, the liquid from the external tank to the recording head via the supply-use tank and the supply-use flow path.

In this manner, according to the present invention, the liquid droplet ejecting apparatus causes the first elastic film to press against the inner wall of the gas chamber of the supply-use tank and pressurizes the liquid chamber configured as a rigid container, whereby the liquid droplet ejecting apparatus raises the pressure inside the liquid chamber of the supply-use tank to a high pressure and initiates supply of the liquid to the recording head. Thereafter, the liquid droplet ejecting apparatus supplies the liquid to the recording head utilizing the elastic returning force by which the first elastic film is moved from the gas chamber side to the liquid chamber side, and the liquid droplet ejecting apparatus supplies, with the first pump, the liquid to the recording head. Thus, liquid droplet ejecting apparatus can instantaneously raise the pressure and supply the liquid to the recording head at a faster flow velocity in comparison to a case where the liquid is supplied to the recording head by only the first pump, and thereafter the liquid droplet ejecting apparatus can maintain the raised pressure because the first elastic film moves even more so that a lot of ink can be supplied to the recording head. Thus, the ability of the liquid droplet ejecting apparatus to discharge air bubbles and contaminants included in the liquid for image recording can be improved.

The liquid droplet ejecting apparatus of the first aspect of the present invention may be configured to further comprise a first elastic member that configures the inner wall of the gas chamber, is disposed in a position in the gas chamber that faces the first elastic film, and is capable of elastic deformation when pressed by the first elastic film from the liquid chamber side. Thus, the elastic deformation of the first elastic member can be utilized to allow the first elastic film to move smoothly.

Further, in the liquid droplet ejecting apparatus with this configuration, the first elastic member may have a shape that accepts the first elastic film along a shape where the first elastic film elastically deforms when the first elastic film is pressed against the first elastic member. Thus, the entire first elastic film can be evenly pressed against the first elastic member so that the first elastic film can be caused to deform more smoothly.

Further, the liquid droplet ejecting apparatus of the first aspect of the present invention may further comprise a recovery-use tank whose inside is sectioned by a second elastic film capable of elastic deformation into a liquid chamber that stores the liquid that has been recovered from the recording head and a gas chamber that is filled with a gas, a recovery-use flow path that is capable of being opened and closed and interconnects the recovery-use tank and the recording head such that the liquid is capable of circulating therethrough, a second pump that includes the function of recovering the liquid from the recording head to the recovery-use tank via the recovery-use flow path and the function of supplying the liquid from the external tank to the recovery-use tank, and a communication path that allows the liquid chamber of the supply-use tank and the liquid chamber of the recovery-use tank to be communicated with each other, wherein the control unit performs control to supply the liquid to the liquid chamber of the supply-use tank such that the liquid chamber of the supply-use tank is filled with the liquid in a state where the supply-use flow path, the recovery-use flow path and the communication path are closed, hold a state where the first elastic film is caused to press against the inner wall of the gas chamber of the supply-use tank, supply the liquid to the liquid chamber of the recovery-use tank such that the liquid chamber of the recovery-use tank is filled with the liquid, hold a state where the second elastic film is caused to press against an inner wall of the gas chamber of the recovery-use tank, open the supply-use path and the communication path, while holding the state where the first elastic film is caused to press against the inner wall of the gas chamber of the supply-use tank, to cause the second elastic film to move from the state where the second elastic film is caused to press against the inner wall of the gas chamber of the recovery-use tank to a state where pressing is released, and supply, with the second pump, the liquid from the external tank to the recording head via the recovery-use tank, the communication path, the supply-use tank and the supply-use path.

Thus, the liquid droplet ejecting apparatus causes the first elastic film to press against the inner wall of the gas chamber of the supply-use tank and pressurizes the liquid chamber configured as a rigid container, whereby the liquid droplet ejecting apparatus raises the pressure inside the liquid chamber of the supply-use tank to a high pressure and initiates supply of the liquid to the recording head. Thereafter, inside the recovery-use tank, the liquid droplet ejecting apparatus supplies the liquid to the recording head utilizing the elastic returning force by which the second elastic film is moved from the gas chamber side to the liquid chamber side, and the liquid droplet ejecting apparatus supplies, with the second pump, the liquid to the recording head. Thus, liquid droplet ejecting apparatus can instantaneously raise the pressure and supply the liquid to the recording head at a faster flow velocity in comparison to a case where the liquid is supplied to the recording head by only the second pump, and thereafter the liquid droplet ejecting apparatus can maintain the raised pressure because the first elastic film moves even more so that a lot of ink can be supplied to the recording head. Thus, the ability of the liquid droplet ejecting apparatus to discharge air bubbles and contaminants included in the liquid for image recording can be improved. Further, by performing pressurization from the recovery-use tank to the supply-use tank, the liquid droplet ejecting apparatus can discharge, at one time, air bubbles and contaminants present in both tanks and in the flow path that connects the recording head to both tanks, and the efficiency of maintenance can be improved.

Further, in the liquid droplet ejecting apparatus with this configuration, the control unit may perform control such that the liquid is supplied by the second pump from the external tank to the recording head via the recovery-use tank, the communication path, the supply-use tank and the supply-use flow path, and thereafter the control unit may perform control to close the communication path, while holding the state where the first elastic film is caused to press against the inner wall of the gas chamber of the supply-use tank, such that the liquid is supplied by the first pump from the external tank to the recording head via the supply-use tank and the supply-use flow path.

Thus, the liquid droplet ejecting apparatus can maintain the force with which the liquid is pumped to the recording head by supplying, with the first pump, the liquid to the recording head in a state where the first elastic film is caused to press against the inner wall of the gas chamber of the supply-use tank, so the ability of the liquid droplet ejecting apparatus to discharge air bubbles and contaminants included in the liquid for image recording can be improved.

Further, in the liquid droplet ejecting apparatus with this configuration, the control unit may perform control to cause the first pump to supply the liquid to the recording head for a predetermined amount of time and thereafter release holding of the state where the first elastic film is caused to press against the inner wall of the gas chamber of the supply-use tank. Thus, the pressure after pressurization by the first pump can be gradually reduced, so a meniscus of the liquid in the recording head can be maintained.

Further, the liquid droplet ejecting apparatus with this configuration may hold the state where the second elastic film is caused to press against the inner wall of the gas chamber of the recovery-use tank by sealing off the gas chamber of the recovery-use tank when the pressure inside the liquid chamber of the recovery-use tank is made larger than the pressure inside the gas chamber of the recovery-use tank to cause the second elastic film to press against the inner wall of the gas chamber of the recovery-use tank by supplying, with the second pump, the liquid from the external tank to the liquid chamber of the recovery-use tank in a state where the recovery-use flow path and the communication path are closed and the gas chamber of the recovery-use tank is open to the atmosphere. Thus, the state where the second elastic film is caused to press against the inner wall of the gas chamber of the recovery-use tank can be held by a simple configuration.

Further, the liquid droplet ejecting apparatus with this configuration may be configured to further comprise a second elastic member that configures the inner wall of the gas chamber of the recovery-use tank, is disposed in a position in the gas chamber of the recovery-use tank that faces the second elastic film, and is capable of elastic deformation when pressed by the second elastic film from the liquid chamber side of the recovery-use tank. Thus, the elastic deformation of the second elastic member can be utilized to allow the second elastic film to move smoothly.

Further, in the liquid droplet ejecting apparatus with this configuration, the second elastic member may have a shape that accepts the second elastic film along a shape where the second elastic film elastically deforms when the second elastic film is pressed against the second elastic member. Thus, the entire second elastic film can be evenly pressed against the second elastic member so that the second elastic film can be caused to deform more smoothly.

Further, the liquid droplet ejecting apparatus with this configuration may hold the state where the first elastic film is caused to press against the inner wall of the gas chamber of the supply-use tank by sealing off the gas chamber of the supply-use tank when the pressure inside the liquid chamber of the supply-use tank is made larger than the pressure inside the gas chamber of the supply-use tank to cause the first elastic film to press against the inner wall of the gas chamber of the supply-use tank by supplying, with the first pump, the liquid from the external tank to the liquid chamber of the supply-use tank in a state where the supply-use flow path is closed and the gas chamber of the supply-use tank is open to the atmosphere. Thus, the state where the first elastic film is caused to press against the inner wall of the gas chamber of the supply-use tank can be held by a simple configuration.

Further, in the liquid droplet ejecting apparatus of the first aspect of the present invention, the recording head may comprise a plurality of modules, each of which includes an ejection opening that ejects liquid droplets, the supply-flow path may be individually disposed with respect to each of the plurality of modules, and an opening/closing element capable of being selectively opened and closed may be disposed in each of the supply-use flow paths. Thus, the liquid droplet ejecting apparatus can discharge air bubbles and contaminants included in the liquid for image recording together with that liquid selectively from the plurality of modules.

According to the present invention, there is obtained the effect that the ability of a liquid droplet ejecting apparatus to discharge air bubbles and contaminants included in a liquid for image recording can be improved.

BRIEF DESCRIPTION OF THE DRAWINGS

Embodiments of the present invention will be described in detail based on the following figures, wherein.

DETAILED DESCRIPTION OF THE INVENTION

Below, the best modes for implementing the present invention will be described in detail with reference to the drawings.

First Embodiment

Figure 1:
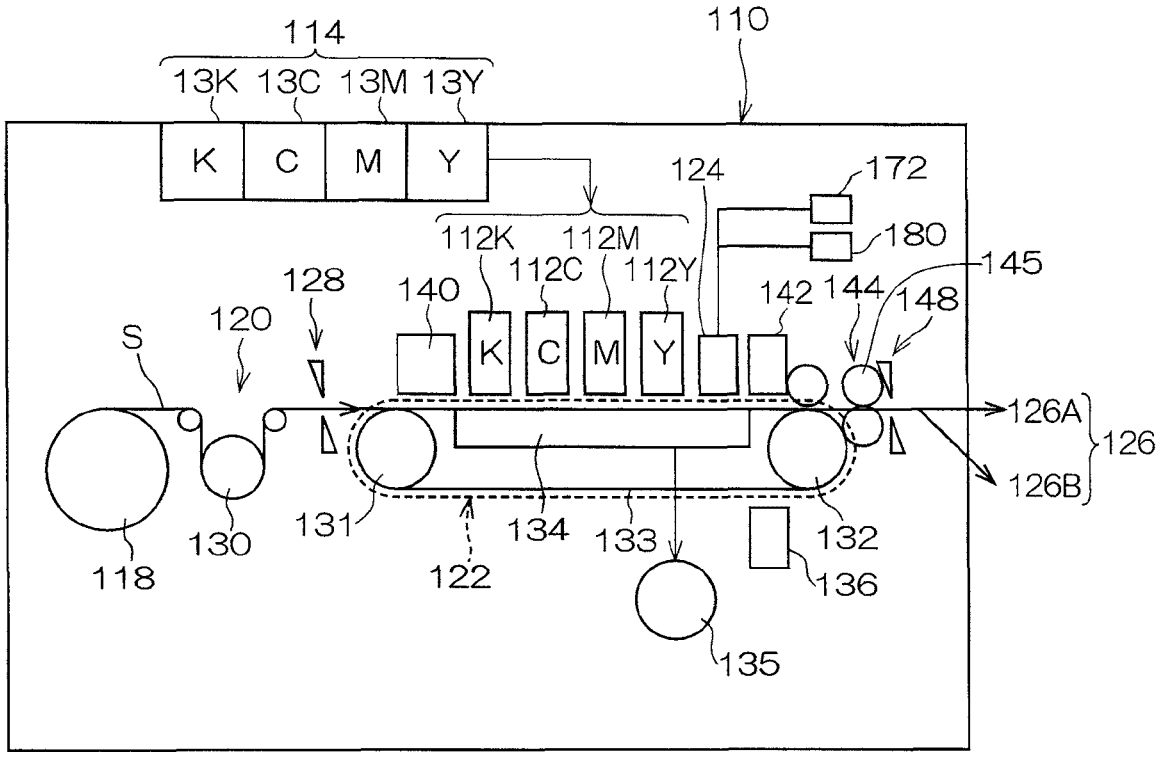
FIG. 1 is a configural diagram showing the configuration of relevant portions of an inkjet recording apparatus pertaining to the embodiments.

In FIG. 1, there is shown an overall configural diagram of an inkjet recording apparatus 110 that represents one embodiment of a liquid droplet ejecting apparatus of the present invention. As shown in FIG. 1, the inkjet recording apparatus 110 is equipped with: plural inkjet recording heads (hereinafter called "heads") 112K, 112C, 112M and 112Y (hereinafter also collectively called a "printing unit 112" when it is not necessary to distinguish by color) that are disposed in correspondence to black (K), cyan (C), magenta (M) and yellow (Y) inks; an ink storing/charging unit 114 that stores the inks supplied to the heads 112K, 112C, 112M and 112Y; a paper supplying unit 18 that supplies recording paper S as a recording medium; a decurling unit 120 that decurls the recording paper S; a belt conveyance unit 122 that is disposed facing a nozzle surface (an ink ejection surface) of the printing unit 112 and conveys the recording paper S while preserving the planarity of the recording paper S; a printing detecting unit 124 that reads the result of printing by the printing unit 112; and a paper discharging unit 126 that discharges the recorded recording paper (printed matter) to the outside. It will be noted that "printing" in the present specification includes the printing of characters and also the printing of images.

The ink storing/charging unit 114 includes ink tanks 13K, 13C, 13M and 13Y that store inks of colors corresponding to the heads 112K, 112C, 112M and 112Y, and the tanks 13K, 13C, 13M and 13Y are respectively communicated with the heads 112K, 112C, 112M and 112Y via necessary pipe lines. Further, the ink storing/charging unit 114 is equipped with informing means that informs an operator when remaining amounts of the inks become small, and the ink storing/charging unit 114 includes a mechanism for preventing erroneous charging between colors.

In FIG. 1, there is shown a magazine of roll paper (continuous paper) as one example of the paper supplying unit 118, but the inkjet recording apparatus 110 may also be equipped with plural magazines whose paper width and paper quality are different. Further, instead of, or in joint use together with, a magazine of roll paper, the paper may also be supplied by a cassette into which cut paper has been stacked and loaded.

When the inkjet recording apparatus 110 is configured to be capable of utilizing plural types of recording media, it is preferred for the inkjet recording apparatus 110 to automatically distinguish the type of recording media (media types) to be used by attaching to the magazine an information recording body such as a barcode or a radio tag in which media type information is recorded and reading the information of that information recording body with a predetermined reading device and for the inkjet recording apparatus 110 to perform ink ejection control so as to realize appropriate ink ejection in accordance with the media types.

The recording paper S that is fed from the paper supplying unit 118 curls as a result of having been loaded in the magazine. In order to decurl the recording paper S, in the decurling unit 120, heat is applied to the recording paper S by a heating drum 130 in the opposite direction of the curling direction of the magazine. At this time, it is more preferred for the inkjet recording apparatus 110 to control the heating temperature such that a printing surface of the recording paper S somewhat weakly curls outward.

In the case of an apparatus configuration that uses roll paper, as shown in FIG. 1, a cutter 128 for cutting is disposed such that the roll paper is cut into a desired size by the cutter 128. In a case of an apparatus configuration that uses cut paper, the cutter 128 is unnecessary.

The recording paper S that has been cut after having been decurled is fed to the belt conveyance unit 122. The belt conveyance unit 122 is configured to have a structure where an endless belt 133 is wrapped between rollers 131 and 132.

The belt 133 has a width dimension that is wider than the width of the recording paper S, and numerous suction holes (not shown) are formed in the belt surface. As shown in FIG. 1, an adsorption chamber 134 is disposed in a position that faces the nozzle surface of the printing unit 112 and a sensor surface of the printing detecting unit 124 on the inner side of the belt 133 wrapped between the rollers 131 and 132, and this adsorption chamber 134 is sucked and placed in a negative pressure by a fan 135, whereby the recording paper S is adsorbed to and held on the belt 133. Instead of a suction adsorption format, the belt conveyance unit 122 may also employ an electrostatic adsorption format.

Motive power of an unillustrated motor is transmitted to at least one of the rollers 131 and 132 around which the belt 133 is wrapped, whereby the belt 133 is driven in a clockwise direction in FIG. 1 and the recording paper S held on the belt 133 is conveyed from left to right in FIG. 1.

When the inkjet recording apparatus 110 prints a marginless print or the like, the inks also adhere to the top of the belt 133, so a belt cleaning unit 136 is disposed in a predetermined position on the outer side of the belt 133 (an appropriate position outside of a printing region). Although details are not shown in regard to the configuration of the belt cleaning unit 136, there are, for example, a configuration that nips a brush roll or a water-absorbing roll, an air blow configuration that blows cleaning air, or a combination of these. In the case of a format that nips a cleaning roll, the cleaning effect is large when the belt linear velocity and the roller linear velocity are changed.

Instead of the belt conveyance unit 122, a configuration that uses a roller nip conveyance mechanism is also conceivable, but when the printing region is nipped between and conveyed by rollers, the rollers contact the printing surface of the paper immediately after printing, so it is easy for the image to run. Consequently, adsorption belt conveyance that does not contact the image surface in the printing region, as in the present example, is preferred.

A heating fan 140 is disposed upstream of the printing unit 112 on a paper conveyance path formed by the belt conveyance unit 122. The heating fan 140 blows hot air onto the recording paper S before printing and heats the recording paper S. By heating the recording paper S immediately before printing, it becomes easier for the inks to dry after they land.

Each of the heads 112K, 112C, 112M and 112Y of the printing unit 112 has a length corresponding to the maximum paper width of the recording paper S intended for the inkjet recording apparatus 110, and the heads are full-line heads where nozzles for ink ejection are plurally arrayed on their nozzle surfaces across a length extending beyond at least one side of the maximum-size recording paper S (the entire width of a drawable range).

The heads 112K, 112C, 112M and 112Y are arranged in the color order of black (K), cyan (C), magenta (M) and yellow (Y) from upstream along a feeding direction of the recording paper S, and the heads 112K, 112C, 112M and 112Y are fixedly installed so as to extend along a direction substantially orthogonal to the conveyance direction of the recording paper S.

The inks of the respectively different colors are ejected onto the recording paper S from the heads 112K, 112C, 112M and 112Y while the recording paper S is conveyed by the belt conveyance unit 122, whereby a color image can be formed on the recording paper S.

In this manner, according to the configuration where the full-line heads 112K, 112C, 112M and 112Y that include nozzle rows covering the entire region of the paper width are disposed separately by color, an image can be recorded on the entire surface of the recording paper S simply by performing, one time (that is, one-time sub-scanning), operation of causing the recording paper S and the printing unit 112 to relatively move in regard to the paper feeding direction (sub-scanning direction). Thus, high-speed printing is possible in comparison to a shuttle head where the recording head reciprocally moves in a direction orthogonal to the paper conveyance direction, and productivity can be improved.

In the present example, there is exemplified a configuration of the standard colors (four colors) of KCMY, but the combination of ink colors and number of colors is not limited to the present embodiment, and light inks, dark inks and special color inks may also be added as needed. For example, a configuration that adds inkjet heads that eject light inks such as light cyan and light magenta is also possible. Further, there is no particular limitation on the arrangement order of the color heads.

The printing detecting unit 124 shown in FIG. 1 includes an image sensor (a line sensor or an area sensor) for imaging the droplet impact result of the printing unit 112 and functions as means that checks ejection characteristics, such as nozzle clogging and landing position error, from the droplet impact image that has been read by the image sensor.

For the printing detecting unit 124 of the present example, there can be suitably used a CCD area sensor where plural light-receiving elements (photoelectric conversion elements) are two-dimensionally arrayed on a light-receiving surface. The area sensor has an imaging range that can at least image the entire region of the ink ejection width (image recording width) resulting from the heads 112K, 112C, 112M and 112Y. The necessary imaging range may be realized by one area sensor or may be ensured by combining (connecting) plural area sensors. Or, a configuration that images the necessary imaging range by supporting an area sensor with a moving mechanism (not shown) and moving (scanning) the area sensor is also possible.

Further, it is also possible to use a line sensor instead of an area sensor. In this case, a configuration that includes a light-receiving element row (photoelectric conversion element row) whose width is wider than at least the ink ejection width (image recording width) resulting from the heads 112K, 112C, 112M and 112Y is preferred.

In this manner, the printing detecting unit 124 is a block including an image sensor, reads an image that has been printed on the recording paper S, performs necessary signal processing and the like to detect the printing situation (whether or not ejection has been performed, landing position error, dot shapes, optical density, etc.), and provides that detection result to a print control unit 72 and a system controller 64 described later.

A post-drying unit 142 is disposed downstream of the printing detecting unit 124. The post-drying unit 142 is means that dries the image surface that has been printed, and, for example, a heating fan is used. It is preferred to avoid contacting the printing surface until the inks after printing have dried, so a format that blows hot air is preferred.

In a case where dye-based inks are printed on porous paper, there is the effect that weatherability of the image increases because contact with things such as ozone that cause destruction of dye molecules is prevented because the holes in the paper are filled in by pressurization.

A heating/pressuring unit 144 is disposed downstream of the post-drying unit 142. The heating/pressuring unit 144 is means for controlling the glossiness of the image surface. The heating/pressuring unit 144 pressures, while heating, the image surface with a pressure roller 145 having a predetermined surface-uneven shape and transfers the uneven shape to the image surface.

The printed matter that has been produced in this manner is discharged from the paper discharging unit 126. Normally it is preferred to separately discharge printed matter on which actual images are printed (printed matter on which intended images have been printed) and printed matter on which test printing has been performed. In this inkjet recording apparatus 110, there is disposed unillustrated sorting means that sorts between printed matter on which actual images have been printed and printed matter on which test printing has been performed and switches the paper discharge path in order to send these to respective discharging units 126A and 126B.

When an actual image and test printing are simultaneously formed in parallel on large paper, the test printing portion is cut off by a cutter 148. Further, although it is not shown, in the discharging unit 126A to which printed matter on which actual images have been printed are sent, there is disposed a sorter that accumulates images separately by order.

Figure 2:
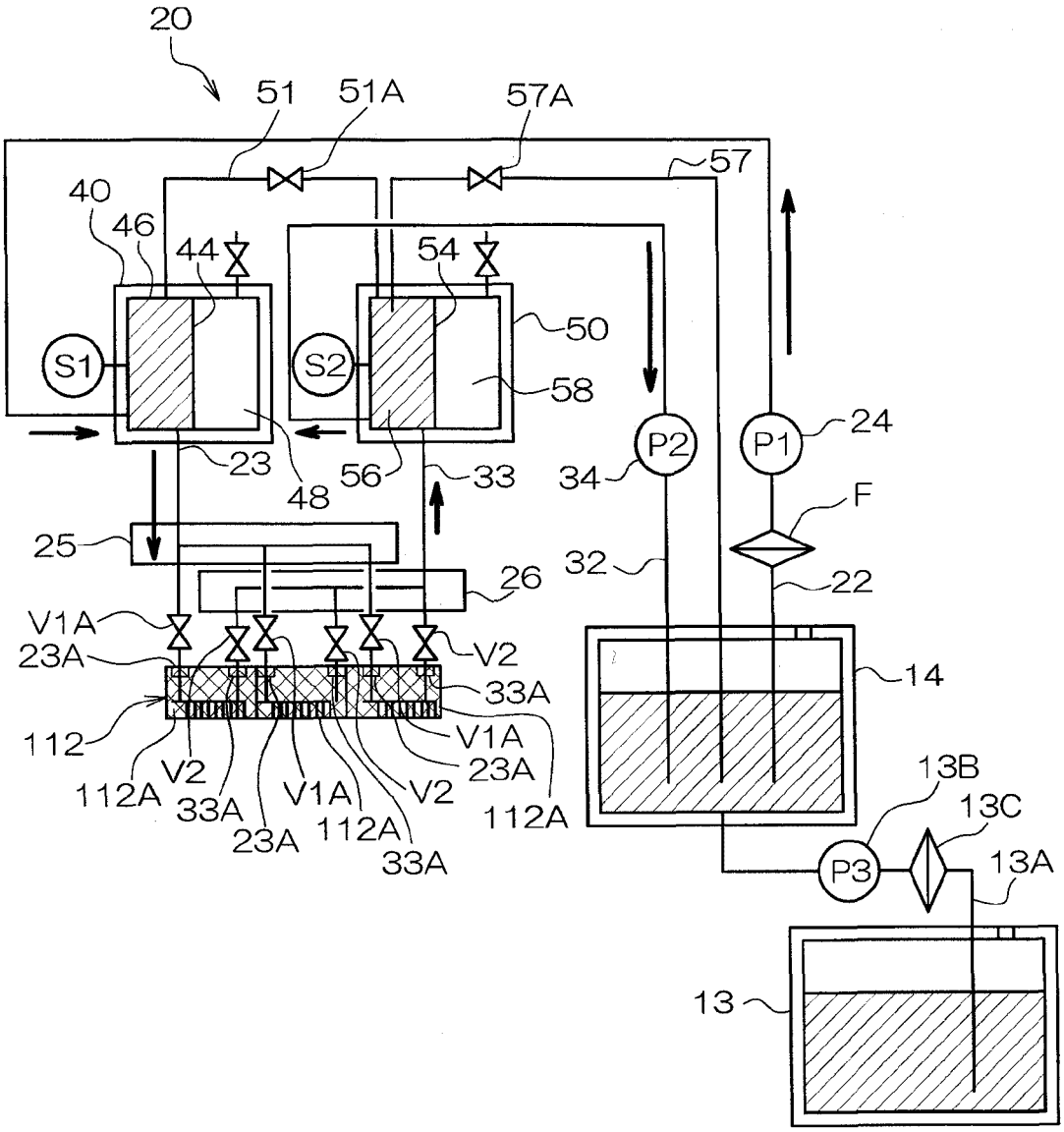
FIG. 2 is a configural diagram of an ink circulation system of the inkjet recording apparatus pertaining to the embodiments.

FIG. 2 is a simplified diagram showing the internal structure of an ink supply system in the inkjet recording apparatus 110. Because the heads 112K, 112C, 112K, 112Y all share the same structure and the ink tanks 13K, 13C, 13M and 13Y all share the same structure, here, reference numeral 112 will represent the heads 112K, 112C, 112M and 112Y and reference numeral 13 will represent the ink tanks 13K, 13C, 13M and 13Y.

The ink tank 13 is connected to a buffer tank 14 via a pipe line 13A. The ink tank 13 and the buffer tank 14 both open to the atmosphere. A pump 13B and a filter 13C are disposed in the pipe line 13A. The ink stored in the ink tank 13 is supplied to the buffer tank 14 as a result of the pump 13B being driven. A predetermined amount of ink is stored in the buffer tank 14 as a result of the ink being supplied from the ink tank 13.

The buffer tank 14 is connected to a supply-use tank 40 via a first flow path 22. Further, the buffer tank 14 is connected to a recovery-use tank 50 via a second flow path 32. Further, the buffer tank 14 is connected to the recovery-use tank 50 via a third flow path 57. In the first flow path 22, there is disposed a first pump 24 that performs pumping between the supply-use tank 40 and the buffer tank 14, and a filter F is disposed between the first pump 24 and the buffer tank 14. In the second flow path 32, there is disposed a second pump 34 that performs pumping between the recovery-use tank 50 and the buffer tank 14. In the third flow path 57, there is disposed a third flow path-use valve 57A that opens and closes the third flow path 57.

The supply-use tank 40 is communicated with the head 112 via a supply-use flow path 23 and a manifold 25, and the recovery-use tank 50 is communicated with the head 112 via a recovery-use flow path 33 and a manifold 26.

The inside of the supply-use tank 40 is sectioned by a first elastic film 44 into a first liquid chamber 46 and a first gas chamber 48. The inside of the recovery-use tank 50 is sectioned by a second elastic film 54 into a second liquid chamber 56 and a second gas chamber 58. The first flow path 22 and the supply-use flow path 23 are communicated with the first liquid chamber 46 of the supply-use tank 40, and the second flow path 32 and the recovery-use flow path 33 are communicated with the second liquid chamber 56 of the recovery-use tank 50. Further, the first liquid chamber 46 is communicated with the second liquid chamber 56 via a fourth flow path 51, and in the fourth flow path 51, there is disposed a fourth flow path-use valve 51 that opens and closes the fourth flow path 51.

The head 112 is divided into a plurality of head bars 112A (in FIG. 2, the head 112 is divided into three head bars 112A), each of which includes an ejection opening that ejects ink droplets, and supply openings 23A for supplying the ink to the head bars 112A and discharge openings 33A for discharging the ink are configured. The supply-use flow path 23 branches in the manifold 25 in front of the supply openings 23A, and the ink is supplied to the head bars 112A from the supply openings 23A. Further, branches of the recovery-use flow path 33 leading from the discharge openings 33A merge together in the manifold 26 in front of the recovery-use tank 50.

In the first embodiment, an example is described where the recording head 112 is divided into the plural head bars 112A, but the recording head 112 may also be a singular body that is not divided.

In the branches of the supply-use flow path 23, there are disposed supply-use valves V1A that open and close the branches of the supply-use flow path 23 branching to each of the supply openings 23A. In the branches of the recovery-use flow path 33, there are disposed recovery-use valves V2 that open and close the branches of the recovery-use flow path 33 leading from each of the discharge openings 33A.

A supply system flow path is configured by the buffer tank 14, the first flow path 22, the supply-use tank 40 and the supply-use flow path 23, and a recovery system flow path is configured by the recovery-use flow path 33, the recovery-use tank 50 and the second flow path 32. A circulation path 20 of an ink supply system is configured by the supply system flow path, the head 112, the recovery system flow path and the buffer tank 14.

Next, the supply-use tank 40 and the recovery-use tank 50 will be described.

Figure 3A:
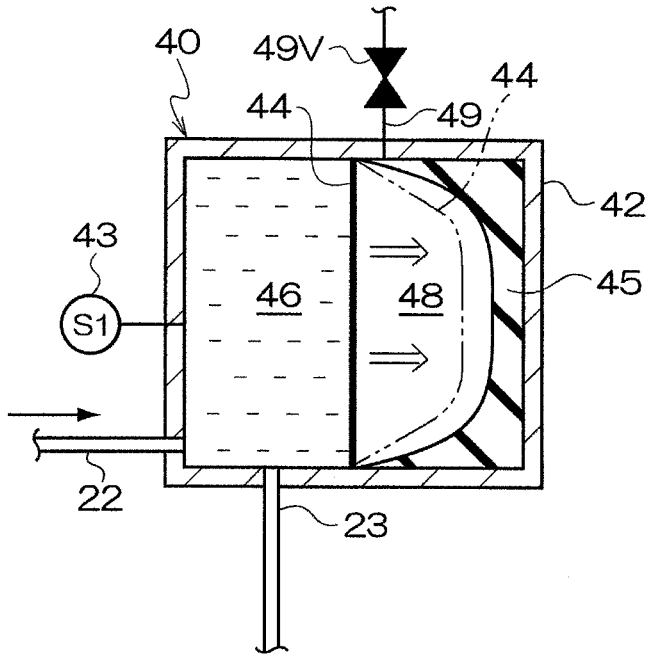
FIG. 3A is a cross-sectional diagram showing the configuration of a supply-use tank pertaining to the embodiments.

As shown in FIG. 3A, the supply-use tank 40 is equipped with a circular cylinder-shaped casing 42, and the space inside the casing 42 is sectioned by the first elastic film 44 into the first liquid chamber 46 and the first gas chamber 48. The first elastic film 44 is disc-shaped and disposed so as to divide the inside of the circular column-shaped casing 42 in its axial direction. The first elastic film 44 is configured by a material capable of elastic deformation, such as a rubber or a resin.

In the first liquid chamber 46, the ink is stored and is communicated with the first flow path 22 and the supply-use flow path 23. A first pressure sensor 43 is connected to the supply-use tank 40. The first pressure sensor 43 is capable of sensing the pressure inside the first liquid chamber 46.

The first gas chamber 48 is filled with a gas, and an open pipe 49 that opens the first gas chamber 48 to the atmosphere is communicated with the first gas chamber 48. A gas chamber valve 49V that opens and closes the open pipe 49 is disposed in the open pipe 49.

A first elastic member 45 is disposed on the casing 42 in a portion of the first gas chamber 48 that faces the first elastic film 44. The first elastic member 45 has a shape that accepts the first elastic film 44 along a shape (see the two-dotted chain line in FIG. 3A) where the first liquid chamber 46 is pressurized such that the first elastic film 44 protrudes toward the first gas chamber 48 side. That is, the first elastic member 45 has a shape configuring a bowl-shaped space on the disc-shaped first elastic film 44 side, and the thickness of the first elastic member 45 becomes thinner from the side along the inner periphery of the casing 42 toward the center of its cylinder axis. The first elastic member 45 is capable of elastic deformation when pressed by the first elastic film 44 and can be configured by a material such as a rubber, a resin, or a porous body.

Figure 3B:
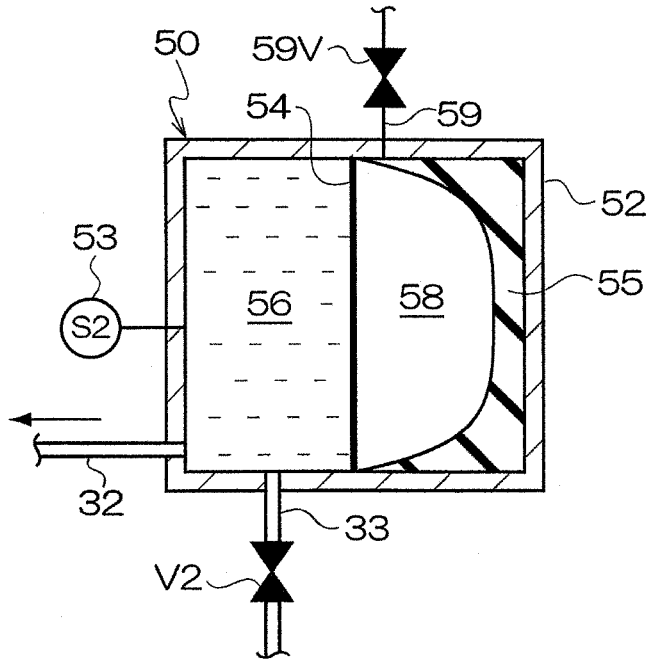
FIG. 3B is a cross-sectional diagram showing the configuration of a recovery-use tank pertaining to the embodiments.

As shown in FIG. 3B, the recovery-use tank 50 has substantially the same shape as that of the supply-use tank 40 and includes a casing 52 that corresponds to the casing 42, the second elastic film 54 that corresponds to the first elastic film 44, the second liquid chamber 56 that corresponds to the first liquid chamber 46, and the second gas chamber 58 that corresponds to the first gas chamber 48. In the second liquid chamber 56, the ink is stored and is communicated with the second flow path 32 and the recovery-use flow path 33. A second pressure sensor 53 is connected to the recovery-use tank 50. The second pressure sensor 53 is capable of sensing the pressure inside the second liquid chamber 56.

The second gas chamber 58 is filled with a gas, and an open pipe 59 that opens the second gas chamber 58 to the atmosphere is communicated with the second gas chamber 58. A gas chamber valve 59V that opens and closes the open pipe 59 is disposed in the open pipe 59.

A second elastic member 55 is disposed on the casing 52 in a portion of the second gas chamber 58 that faces the second elastic film 54. The second elastic member 55 has a shape that accepts the second elastic film 54 along a shape where the second liquid chamber 56 is pressurized such that the second elastic film 54 protrudes toward the second gas chamber 58. That is, the second elastic member 55 has a shape configuring a bowl-shaped space on the circular column-shaped second elastic film 54 side, and the thickness of the second elastic member 55 becomes thinner from the side along the inner periphery of the casing 52 toward the center of its cylinder axis. The second elastic member 55 is capable of elastic deformation when pressed by the second elastic film 54 and can be configured by a material such as a rubber, a resin or a porous body.

In the first embodiment, the first elastic member 45 and the second elastic member 55 have shapes that accept the swelling and protruding first elastic film 44 and second elastic film 54, but it is not invariably necessary for the first elastic member 45 and the second elastic member 55 to have such shapes; however, particularly by configuring the first elastic film 45 and the second elastic member 55 to have such shapes, the degree to which the first elastic film 44 tightly adheres to the first elastic member 45 and the degree to which the second elastic film 54 tightly adheres to the second elastic member 55 can be raised.

Figure 4:
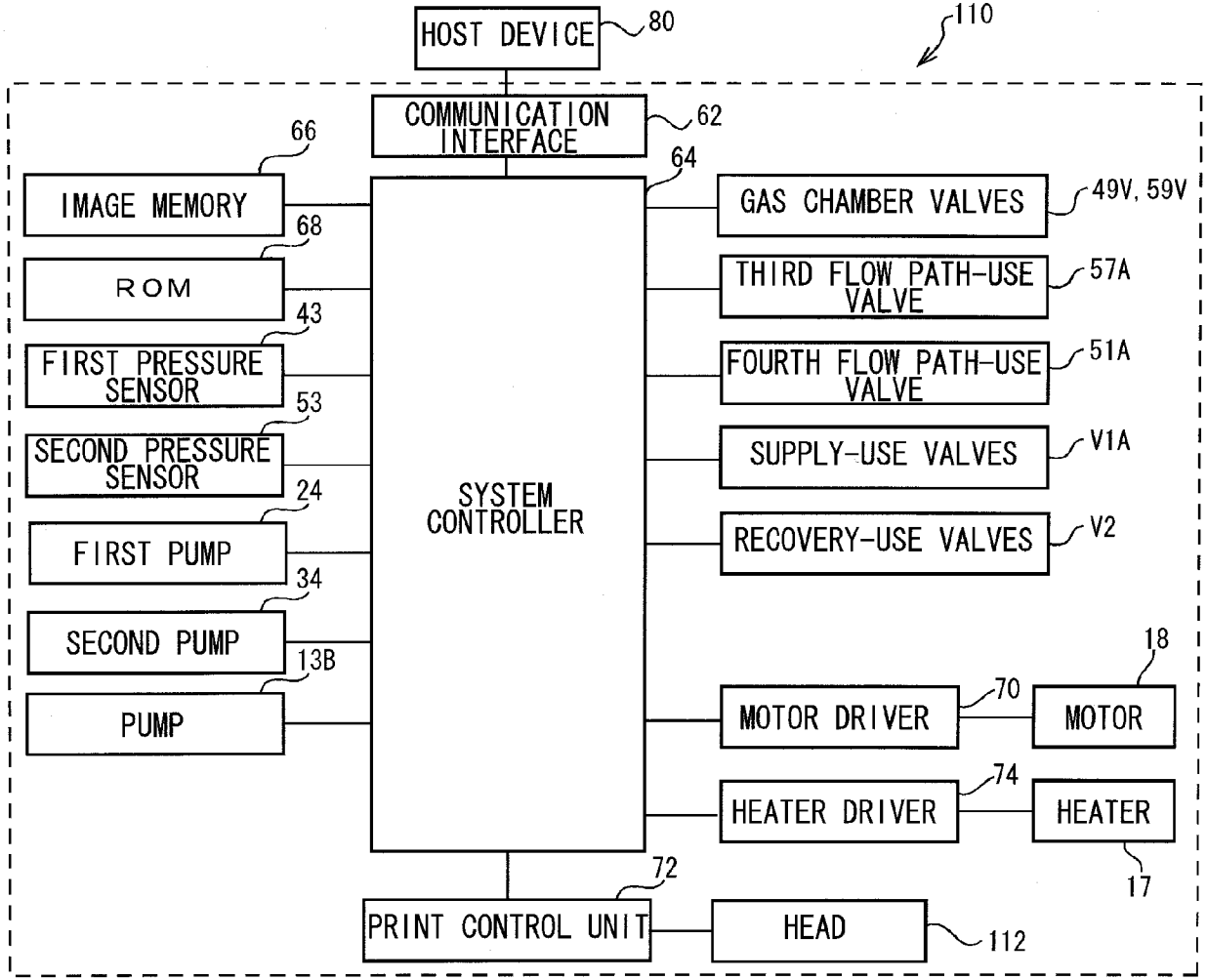
FIG. 4 is a block diagram showing the configuration of relevant portions of an electrical system of the inkjet recording apparatus pertaining to the embodiments.

In FIG. 4, there is shown a block diagram showing the configuration of relevant portions of an electrical system of the inkjet recording apparatus 110 pertaining to the embodiments.

As shown in FIG. 4, the inkjet recording apparatus 110 is configured to include a heater 17, a motor 18, the pump 13B, the first pump 24, the second pump 34, the first pressure sensor 43, the second pressure sensor 53, a communication interface 62, a system controller 64, an image memory 66, a read-only memory (ROM) 68, a motor driver 70, a print control unit 72, a heater driver 74, the heads 112, the gas chamber valves 49V and 59V, the third flow path-use valve 57A, the fourth flow path-use valve 51A, the supply-use valves V1A and the recovery-use valves V2.

The communication interface 62, the image memory 66, the ROM 68, the motor driver 70, the print control unit 72, the heater driver 74, the pump 13B, the first pump 24, the second pump 34, the first pressure sensor 43, the second pressure sensor 53, the gas chamber valves 49V and 59V, the third flow path-use valve 57A, the fourth flow path-use valve 51A, the supply-use valves V1A and the recovery-use valves V2 are connected to the system controller 52.

The communication interface 62 is an interface unit that interfaces with a host device 80 that is used in order for a user to issue a drawing instruction and the like with respect to the inkjet recording apparatus 110. For the communication interface 62, a serial interface, such as a universal serial bus (USB), IEEE 1394, Ethernet (registered trademark) or a wireless network, or a parallel interface, such as the Centronics interface, can be applied. In this portion, a buffer memory (not shown) for increasing the speed of communication may also be installed.

Image information that has been sent from the host device 80 and which represents an image that is to be formed on the recording paper S is imported to the inkjet recording apparatus 110 via the communication interface 62 and is temporarily stored in the image memory 66. The image memory 66 is storage means that stores the image information that has been inputted via the communication interface 62, and the reading of data from and the writing of data to the image memory 66 are performed through the system controller 64. The image memory 66 is not limited to a memory comprising a semiconductor device and may also comprise a magnetic medium such as a hard disk.

The system controller 64 is configured by a central processing unit (CPU) and peripheral circuits, functions as a control device that controls the entire inkjet recording apparatus 110 in accordance with a predetermined program, and functions as a processing device that performs various types of processing. That is, the system controller 64 controls the communication interface 62, the image memory 66, the ROM 68, the motor driver 70, the print control unit 72, the pump 13B, the first pump 24, the second pump 34, the first pressure sensor 43, the second pressure sensor 53, the gas chamber valves 49V and 59V, the third flow path-use valve 57A, the fourth flow path-use valve 51A, the supply-use valves V1A and the recovery-use valves V2, controls communication with the host device 80, controls the reading and writing of the image memory 66 and the ROM 68, and generates control signals that control the driving of the motor 18. The system controller 64 also transmits controls signals and the image information stored in the image memory 66 to the print control unit 72.

Further, in the ROM 68, there are stored programs that the system controller 64 executes and various types of data and the like necessary for control. The ROM 68 may be non-rewritable storage means, but it is preferable to use rewritable storage means such as an EEPROM when various types of data are to be updated as needed.

The image memory 66 is utilized as a region for temporarily storing image information and is also utilized as a program development region and a processing work region (computing region) of the system controller 64.

The motor driver 70 is a driver (drive circuit) that drives the motor 18 of the conveyance system in accordance with an instruction from the system controller 64. The heater driver 74 is a driver that drives the heater 17 of the post-drying unit 142 and the like in accordance with an instruction from the system controller 64.

The print control unit 72 functions as signal processing means that performs processing such as various types of treatment and correction for generating signals for ejection control from the image information that has been transmitted from the system controller 64 in accordance with control by the system controller 64 and controls ejection driving of the heads 112 on the basis of ink ejection data that the print control unit 72 has generated.

Next, circulation of the ink during printing will be described.

In the circulation path 20 of the inkjet recording apparatus 110 during printing, circulation of the ink is always performed as follows.

In the circulation path 20, the ink is delivered from the supply-use tank 40 through the head 112 to the recovery-use tank 50 by setting the pressure on the ink supply side higher by a predetermined amount than the pressure on the ink recovery side. Here, assuming that Pin represents the pressure inside the first liquid chamber 46, Pout represents the pressure inside the second liquid chamber 56 and Pnzl represents the back pressure (negative pressure) of the nozzles from which the ink is ejected, then a predetermined back pressure is applied to the nozzles so as to satisfy the relationship of Pin+Hin>Pnzl>Pout+Hout (mm $H_2O$) (Hin is a difference in pressure (hydraulic head pressure) that arises because of a difference in height between the nozzle surface and the first pressure sensor 43, and Hout is a difference in pressure (hydraulic head pressure) that arises because of a difference in height between the nozzle surface and the second pressure sensor 53). The pressure in the first liquid chamber 46 of the supply-use tank 40 and the pressure in the second liquid chamber 56 of the recovery-use tank 50 are controlled by the first pump 24 and the second pump 34 on the basis of the pressure inside the first liquid chamber 46 that has been sensed by the first pressure sensor 43 and the pressure inside the second liquid chamber 56 that has been sensed by the second pressure sensor 53 such that the pressure in the first liquid chamber 46 and the pressure in the second liquid chamber 56 respectively become the predetermined pressures Pin and Pout. Thus, the ink circulates inside the circulation path 20.

At this time, the first elastic film 44 and the second elastic film 54 are disposed in positions where they do not contact the first elastic member 45 and the second elastic member 55. Further, the gas chamber valves 49V and 59V of the open pipes 49 and 59 are closed. The supply-use valves V1A and the recovery-uses valves V2 disposed in the circulation path 20 are open.

By causing the ink to circulate as described above, ink thickening at the nozzles can be prevented, an excellent ink ejection state can be maintained for a long period of time, and high printing quality can be maintained for a long period of time.

Further, pressure fluctuations resulting from operation of the first pump 24 and the second pump 34 and pressure fluctuations accompanying ink consumption in the head 112 are absorbed and controlled by the first elastic film 44, the second elastic film 54, the first gas chamber 48 and the second gas chamber 58, the pressure in the supply-use tank 40 and the pressure in the recovery-use tank 50 can be easily maintained at a constant, the back pressure of the nozzles inside the head 112 can be maintained at a constant, and high printing quality can be maintained.

In the inkjet recording apparatus 110 pertaining to the first embodiment, when an instruction to remove air bubbles and contaminants included in the ink inside the circulation path 20 and fill the head 112 with the ink is inputted, pressurized discharge processing to pressurize and discharge the ink inside the circulation path 20 from the nozzles of the head 112 is executed.

Figure 5:
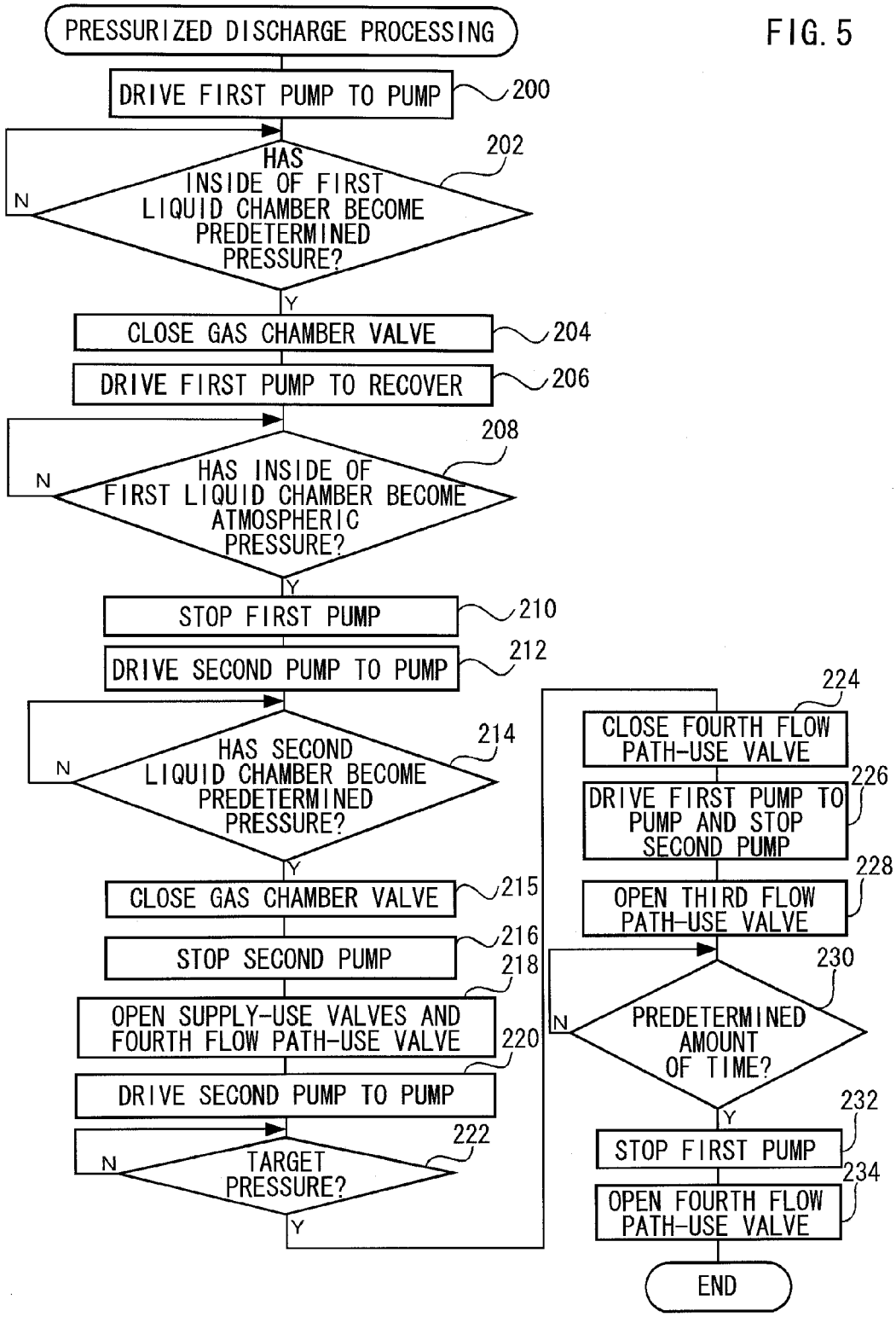
FIG. 5 is a flowchart showing a flow of processing by a pressurized discharge processing program pertaining to a first embodiment.

Below, the action of the inkjet recording apparatus 110 when this pressurized discharge processing is executed will be described with reference to FIG. 5. FIG. 5 is a flowchart showing a flow of processing by a pressurized discharge processing program that is executed by the system controller 64 at that time. This program is stored beforehand in a predetermined region of the ROM 68. Further, here, in order to avoid confusion, a case will be described where the gas chamber valves 49V and 59V are open and where the recovery-use valves V2, the third flow path-use valve 57A, the fourth flow path-use valve 51A and the three supply-use valves V1A are closed.

Figure 6A:
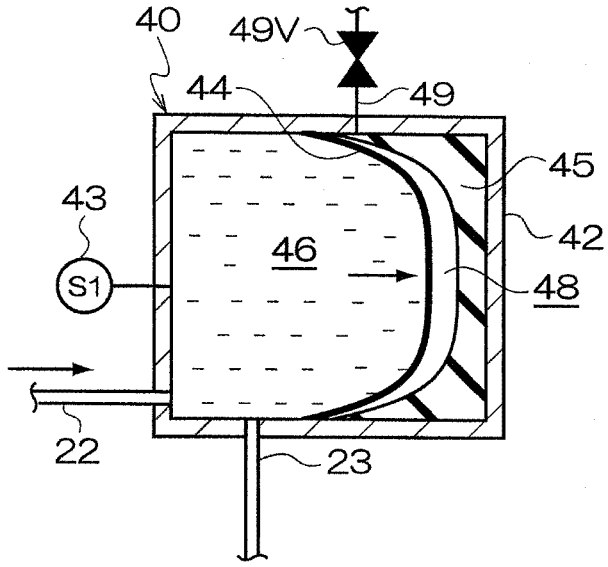
FIG. 6A, FIG. 6B and FIG. 6C are diagrams showing a process until a first elastic film pertaining to the embodiments is pressed against a first elastic member, with FIG. 6A showing a state immediately before the first elastic film contacts the first elastic member, FIG. 6B showing a state where the first elastic film is contacting the first elastic member, and FIG. 6C showing a state where the first elastic film is pressing the first elastic member a predetermined amount.
Figure 6B:
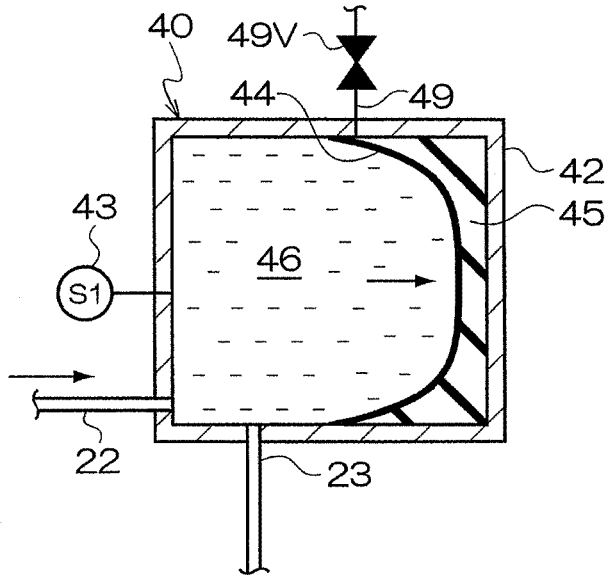
Figure 6C:
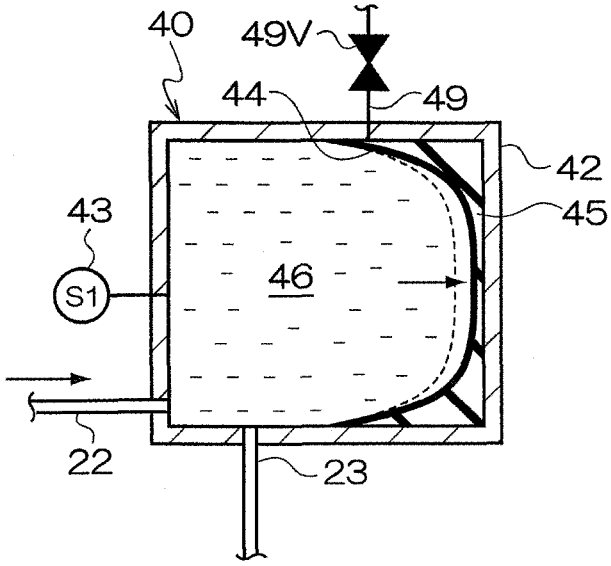

In step 200 of FIG. 5, the first pump 24 is driven to pump the ink stored in the buffer tank 14 to the first liquid chamber 46 of the supply-use tank 40. In the next step 202, the program stands by until the pressure inside the first liquid chamber 46 becomes a predetermined target pressure. In the first embodiment, as one example, as shown in FIG. 6A, FIG. 6B and FIG. 6C, a pressure that causes the first elastic film 44 to press against the first elastic member 45 of the first gas chamber 48 and elastically deform the first elastic member 45 by a predetermined amount is applied as the predetermined target pressure.

In the next step 204, the gas chamber valve 49V is closed. Thus, the first gas chamber 48 is sealed off, and the state where the first elastic film 44 is caused to press against the first elastic member 45 is held.

In the next step 206, the first pump 24 is driven to recover the ink inside the first liquid chamber 46 of the supply-use tank 40. In the next step 208, the program stands by until the pressure inside the first liquid chamber 46 becomes a predetermined pressure (here, a negative pressure where it becomes possible to maintain a meniscus in the nozzles).

In the next step 210, the driving of the first pump 24 is stopped. Then, the program moves to step 212, where the second pump 34 is driven to pump the ink stored in the buffer tank 14 to the second liquid chamber 56 of the recovery-use tank 50. In step 214, the program stands by until the pressure inside the second liquid chamber 56 becomes a predetermined target pressure. In the first embodiment, a pressure that causes the second elastic film 54 to press against the second elastic member 55 of the second gas chamber 58 and elastically deform the second elastic member 55 by a predetermined amount is applied as the predetermined target pressure.

In the next step 215, the liquid chamber valve 59V is closed. Thus, the second gas chamber 58 is sealed off, and the state where the second elastic film 54 is caused to press against the second elastic member 55 is held.

Figure 7:
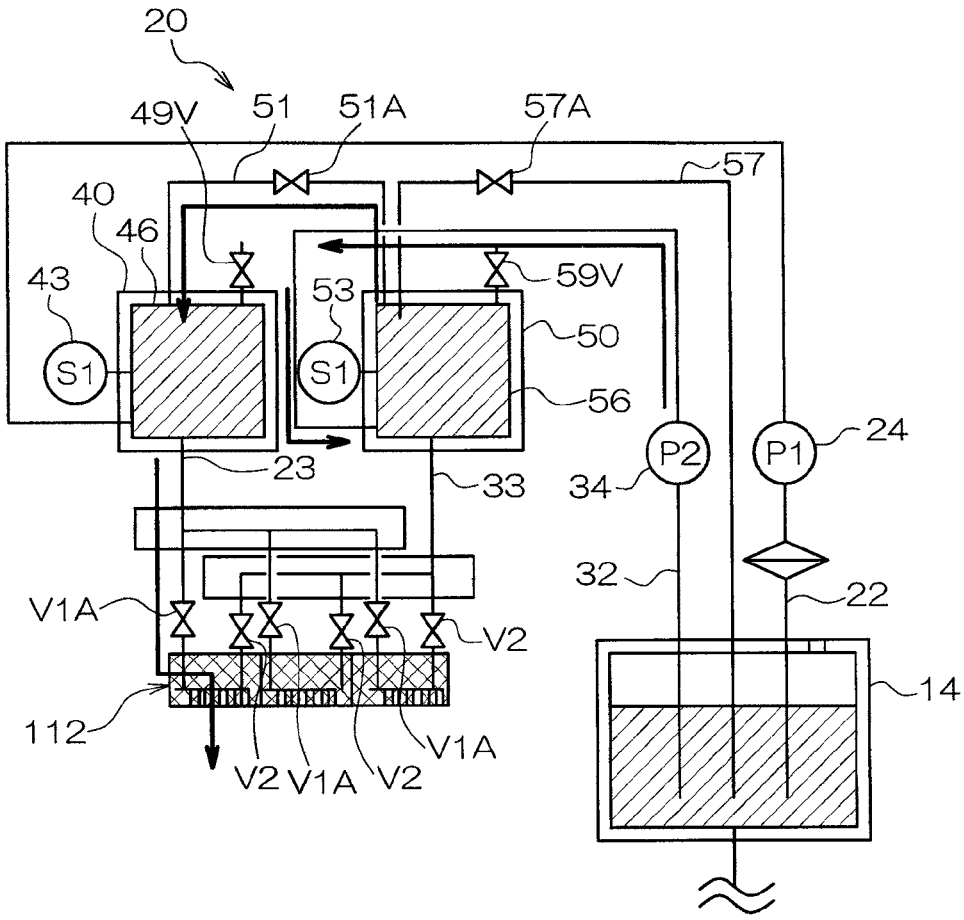
FIG. 7 is a diagram showing a state of the ink circulation system when starting pressurization of a recording head of the inkjet recording apparatus pertaining to the first embodiment.
Figure 10:
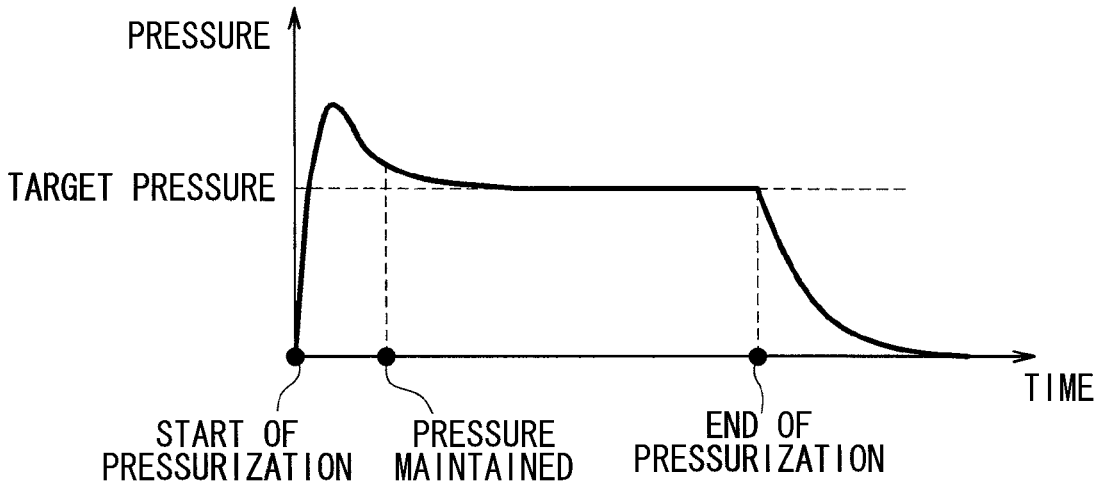
FIG. 10 is a diagram showing a pressure waveform in a supply-use flow path of the inkjet recording apparatus pertaining to the first embodiment.

In the next step 216, the driving of the second pump 34 is stopped. Then, the program moves to step 218, where the three supply-use valves V1A and the fourth flow path-use valve 51A are opened. In the next step 220, the second pump 34 is driven to pump the ink stored in the buffer tank 14 to the second liquid chamber 56 of the recovery-use tank 50. Thus, the ink is pumped as indicated by the arrows in FIG. 7 as one example. Further, the second elastic film 54 is moved from the second gas chamber 58 side to the second liquid chamber 56 side because of its own elastic returning force. Thus, in comparison to a case where the ink is pumped by only the second pump 34, a lot of ink is instantaneously delivered to the head 112 via the fourth flow path 51, the supply-use tank 40 and the supply-use flow path 23, and, as shown in FIG. 10, the pressure of the ink acting on the head 112 quickly rises and thereafter gradually falls.

Figure 8:
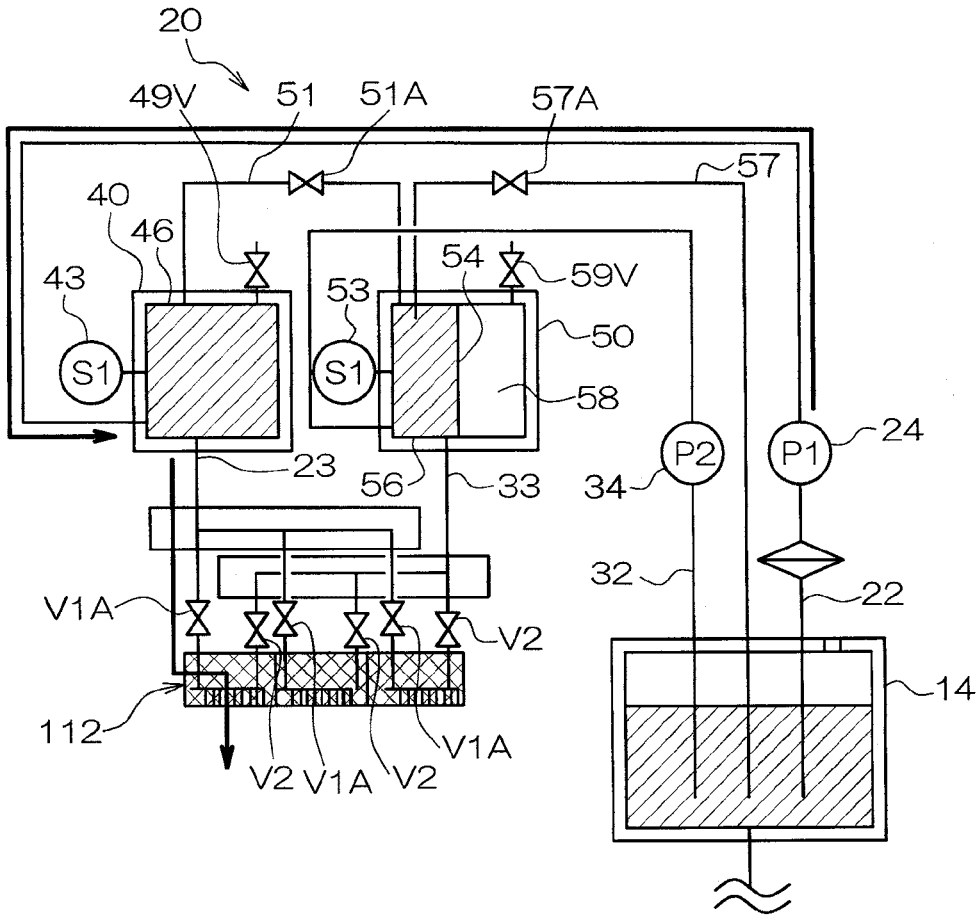
FIG. 8 is a diagram showing a state of the ink circulation system when pressurizing, while maintaining flow rate and pressure, the recording head of the inkjet recording apparatus pertaining to the first embodiment.

In the next step 222, the program stands by until the pressure inside the second liquid chamber 56 reaches a target pressure (e.g., a pressure that is ideal for discharging air bubbles and contaminants included in the ink from the head 112) after the driving of the second pump 34 is started by the processing of step 220. In the next step 224, the program closes the fourth flow path-use valve 51A. Thereafter, the program moves to step 226, where the first pump 24 is driven to pump the ink stored in the buffer tank 14 to the first liquid chamber 46 of the supply-use tank 40 and the second pump 34 is stopped. Thus, the ink is pumped as indicated by the arrows in FIG. 8 as one example. Further, at this time, the ink is pumped by the first pump 24 in a state where the state where the first elastic film 44 is caused to press against the first elastic film 45 is held, so the pressure of the ink acting on the head 112 is maintained as shown in FIG. 10 as one example.

In the next step 228, the third flow path-use valve 57A is opened. In the next step 230, the program stands by until a predetermined amount of time (here, an amount of time regarded as when air bubbles and contaminants included in the ink have been discharged) elapses after the processing of step 226 is executed.

Figure 9:
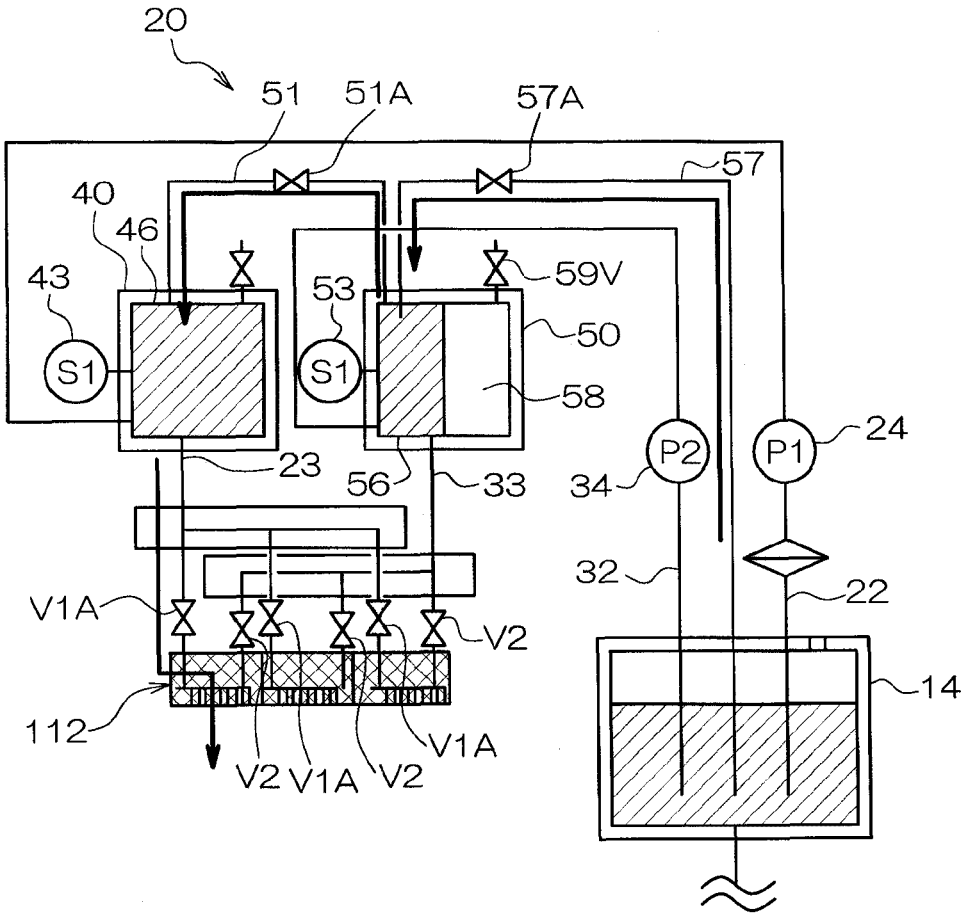
FIG. 9 is a diagram showing a state of the ink circulation system when ending pressurization of the recording head pertaining to the first embodiment.

In the next step 232, the driving of the first pump 24 is stopped. In the next step 234, the fourth flow path-use valve 51A is opened. Thereafter, the pressurized discharge processing program ends. Because of the processing of step 234, the ink moves inside the circulation path 20 as indicated by the arrows in FIG. 9 as one example, and the inside of the first liquid chamber 46, the inside of the supply-use flow path 23 and the inside of the head 112 are depressurized. At this time, the first elastic film 44 is moved from the first gas chamber 48 side to the first liquid chamber 46 side because of its own elastic returning force, so the pressure of the ink acting on the head 112 gradually falls as shown in FIG. 10 as one example.

As described in detail above, the inkjet recording apparatus 110 pertaining to the first embodiment comprises: the head 112 that ejects ink droplets onto the recording paper S to record an image; the supply-use tank 40 whose inside is sectioned by the first elastic 44 capable of elastic deformation into the first liquid chamber 46 that stores an ink and the first gas chamber 48 that is filled with a gas; the supply-use flow path 23 that is capable of being opened and closed and interconnects the supply-use tank 40 and the head 112 such that the ink is capable of circulating therethrough; the first pump 24 that pumps the ink stored in the first liquid chamber 46 to the head 112 via the supply-use flow path 23 that has been opened by supplying the ink from the buffer tank 14 in which the ink is stored to the first liquid chamber 46; the recovery-use tank 50 whose inside is sectioned by the second elastic film 54 capable of elastic deformation into the second liquid chamber 56 that stores the ink that has been recovered from the head 112 and the second gas chamber 58 that is filled with a gas; the recovery-use flow path 33 that is capable of being opened and closed and interconnects the recovery-use tank 50 and the head 112 such that the ink is capable of circulating therethrough; the second pump 34 that includes the function of recovering the ink from the head 112 to the recovery-use tank 50 via the recovery-use flow path 33 and the function of supplying the ink from the buffer tank 14 to the recovery-use tank 50; the fourth flow path 51 that allows the first liquid chamber 46 and the second liquid chamber 56 to be communicated with each other; and the system controller 64. The system controller 64 performs control to supply the ink to the first liquid chamber 46 such that the first liquid chamber 46 is filled with the ink in a state where the supply-use flow path 23, the recovery-use flow path 33 and the fourth flow path 51 are closed, hold a state where the first elastic film 44 is caused to press against the inner wall of the first gas chamber 48, supply the ink to the second liquid chamber 56 such that the second liquid chamber 56 is filled with the ink, hold a state where the second elastic film 54 is caused to press against the inner wall of the second gas chamber 58, thereafter open the supply-use flow path 23 and the fourth flow path 51, while holding the state where the first elastic film 44 is caused to press against the inner wall of the first gas chamber 48, to cause the second elastic film 54 to move from the state where the second elastic film 54 is caused to press against the inner wall of the second gas chamber 58 to a state where pressing is released, and supply, with the second pump 34, the ink from the buffer tank 14 to the head 112 via the recovery-use tank 50, the fourth flow path 51, the supply-use tank 40 and the supply-use flow path 23. Thereafter, the system controller 64 performs control to close the fourth flow path 51, while holding the state where the first elastic film 44 is caused to press against the inner wall of the first gas chamber 48, such that the ink is supplied by the first pump 24 from the buffer tank 14 to the head 112 via the supply-use tank 40 and the supply-use flow path 23. In this manner, the inkjet recording apparatus 110 supplies the ink to the head 112 utilizing the elastic returning force by which the second elastic film 54 is moved from the second gas chamber 58 side to the second liquid chamber 56 side, and the inkjet recording apparatus 110 supplies, with the second pump 34, the ink to the head 112. Thus, the inkjet recording apparatus 110 can instantaneously raise the pressure and supply the ink to the head 112 at a faster flow velocity in comparison to a case where the ink is supplied to the head 112 by only the second pump 34, and thereafter the inkjet recording apparatus 110 can maintain the raised pressure because the first elastic film 44 moves even more so that a lot of ink can be supplied to the head 112. Thus, the ability of the inkjet recording apparatus 110 to discharge air bubbles and contaminants included in the ink can be improved. Further, by performing pressurization from the recovery-use tank 50 to the supply-use tank 40, the inkjet recording apparatus 110 can discharge, at one time, air bubbles and contaminants present in both tanks and in the flow path that connects the head 112 to both tanks, and the efficiency of maintenance can be improved. Moreover, the inkjet recording apparatus 110 can maintain the force with which the ink is pumped to the head 112 by supplying, with the first pump 24, the ink to the head 112 in a state where the first elastic film 44 is caused to press against the inner wall of the first gas chamber 48, so the ability of the inkjet recording apparatus 110 to discharge air bubbles and contaminants included in the ink can be improved.

Further, according to the inkjet recording apparatus 110 pertaining to the first embodiment, the system controller 64 performs control to cause the first pump 24 to supply the ink to the head 112 for a predetermined amount of time and thereafter release holding of the state where the first elastic film 44 is caused to press against the inner wall of the first gas chamber 48. Thus, the pressure after pressurization by the first pump 24 can be gradually reduced, so a meniscus of the ink in the head 112 can be maintained.

Further, according to the inkjet recording apparatus 110 pertaining to the first embodiment, the inkjet recording apparatus 110 holds the state where the second elastic film 54 is caused to press against the inner wall of the second gas chamber 58 by sealing off the second gas chamber 58 when the pressure inside the second liquid chamber 56 is made larger than the pressure inside the second gas chamber 58 to cause the second elastic film 54 to press against the inner wall of the second gas chamber 58 by supplying, with the second pump 34, the ink from the buffer tank 14 to the second liquid chamber 56 in a state where the recovery-use flow path 33 and the fourth flow path 51 are closed and the second gas chamber 58 is open to the atmosphere. Thus, the state where the second elastic film 54 is caused to press against the inner wall of the second gas chamber 58 can be held by a simple configuration.

Further, according to the inkjet recording apparatus 110 pertaining to the first embodiment, the inkjet recording apparatus 110 is equipped with the second elastic member 55 that configures the inner wall of the second gas chamber 58, is disposed in a position in the second gas chamber 58 that faces the second elastic film 54, and is capable of elastic deformation when pressed by the second elastic film 54 from the second liquid chamber 56 side. Thus, the elastic deformation of the second elastic member 55 can be utilized to allow the second elastic film 54 to move smoothly.

Further, according to the inkjet recording apparatus 110 pertaining to the first embodiment, the second elastic member 55 has a shape that accepts the second elastic film 54 along a shape where the second elastic film 54 elastically deforms when the second elastic film 54 is pressed against the second elastic member 55. Thus, the entire second elastic film 54 can be evenly pressed against the second elastic member 55 so that the second elastic film 54 can be caused to deform more smoothly.

Further, according to the inkjet recording apparatus 110 pertaining to the first embodiment, the inkjet recording apparatus 110 holds the state where the first elastic film 44 is caused to press against the inner wall of the first gas chamber 48 by sealing off the first gas chamber 48 when the pressure inside the first liquid chamber 46 is made larger than the pressure inside the first gas chamber 48 to cause the first elastic film 44 to press against the inner wall of the first gas chamber 48 by supplying, with the first pump 24, the ink from the buffer tank 14 to the first liquid chamber 46 in a state where the supply-use flow path 23 is closed and the first gas chamber 48 is open to the atmosphere. Thus, the state where the first elastic film 44 is caused to press against the inner wall of the first gas chamber 48 can be held by a simple configuration.

Further, according to the inkjet recording apparatus 110 pertaining to the first embodiment, the inkjet recording apparatus 110 is equipped with the first elastic member 45 that configures the inner wall of the first gas chamber 48, is disposed in a position in the first gas chamber 48 that faces the first elastic film 44, and is capable of elastic deformation when pressed by the first elastic film 44 from the first liquid chamber 46 side. Thus, the elastic deformation of the first elastic member 45 can be utilized to allow the first elastic film 44 to move smoothly.

Further, according to the inkjet recording apparatus 110 pertaining to the first embodiment, the first elastic member 45 has a shape that accepts the first elastic film 44 along a shape where the first elastic film 44 elastically deforms when the first elastic film 44 is pressed against the first elastic member 45. Thus, the entire first elastic film 44 can be evenly pressed against the first elastic member 45 so that the first elastic film 44 can be caused to deform more smoothly.

Second Embodiment

Next, a second embodiment will be described. The configuration of the inkjet recording apparatus pertaining to the second embodiment is the same as that of the inkjet recording apparatus 110 pertaining to the first embodiment, so description thereof will be omitted here.

Figure 11:
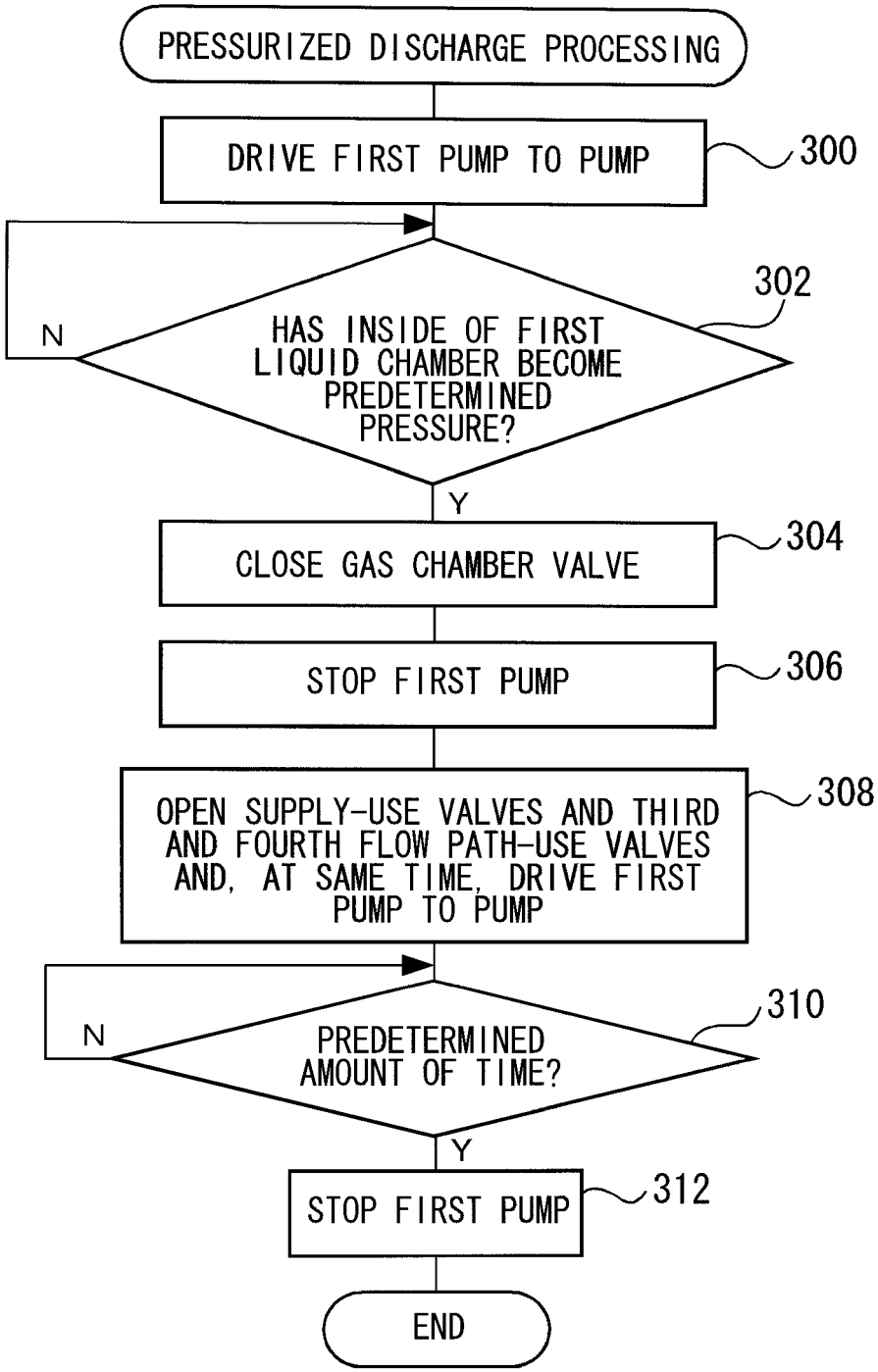
FIG. 11 is a flowchart showing a flow of processing by a pressurized discharge processing program pertaining to a second embodiment.

Next, the action of the inkjet recording apparatus 110 when pressurized discharge processing pertaining to the second embodiment is executed will be described with reference to FIG. 11. FIG. 11 is a flowchart showing a flow of processing by a pressurized discharge processing program that is executed by the system controller 64 at that time. This program is stored beforehand in a predetermined region of the ROM 68. Further, here, in order to avoid confusion, a case will be described where the gas chamber valves 49V and 59V are open and where the supply-use valves V1A, the recovery-use valves V2, the third flow path-use valve 57A and the fourth flow path-use valve 51A are closed.

In step 300 of FIG. 11, the first pump 24 is driven to pump the ink stored in the buffer tank 14 to the first liquid chamber 46 of the supply-use tank 40. In the next step 302, the program stands by until the pressure inside the first liquid chamber 46 becomes a predetermined target pressure. In the second embodiment, as one example, as shown in FIG. 6A, FIG. 6B and FIG. 6C, a pressure that causes the first elastic film 44 to tightly contact the first elastic member 45 of the first gas chamber 48 and elastically deform the first elastic member 45 by a predetermined amount is applied as the predetermined target pressure.

In the next step 304, the gas chamber valve 49V is closed. Thus, the first gas chamber 48 is sealed off, and the state where the first elastic film 44 is caused to press against the first elastic member 45 is held.

In the next step 306, the driving of the first pump 24 is stopped. Then, the program moves to step 308, where the supply-use valves V1A are opened and, at the same time, the first pump 24 is driven to pump the ink stored in the buffer tank 14 to the first liquid chamber 46 of the supply-use tank 40. Moreover, the gas chamber valve 49V is opened at the same time or a predetermined amount of time later. Thus, the first elastic film 44 is moved by its own elastic returning force from the first gas chamber 48 side to the first liquid chamber 46 side, so the inkjet recording apparatus 110 can instantaneously raise the pressure and supply the liquid to the head 112 at a faster flow velocity in comparison to a case where the ink is pumped by only the first pump 24, and thereafter the inkjet recording apparatus 110 can maintain the raised pressure because the first elastic film 44 moves even more so that a lot of ink can be supplied to the head 112. Thus, the ability of the inkjet recording apparatus 110 to discharge air bubbles and contaminants included in the ink can be improved.

In the next step 310, the program stands by until a predetermined amount of time (here, an amount of time regarded as when contaminants included in the ink have been discharged) elapses after the processing of step 308 is executed. In the next step 312, the driving of the first pump 24 is stopped. Thereafter, the pressurized discharge processing program ends.

As described in detail above, the inkjet recording apparatus 110 pertaining to the second embodiment comprises: the head 112 that ejects ink droplets onto the recording paper S to record an image; the supply-use tank 40 whose inside is sectioned by the first elastic 44 capable of elastic deformation into the first liquid chamber 46 that stores an ink and the first gas chamber 48 that is filled with a gas; the supply-use flow path 23 that is capable of being opened and closed and interconnects the supply-use tank 40 and the head 112 such that the ink is capable of circulating therethrough; the first pump 24 that pumps the ink stored in the first liquid chamber 46 to the head 112 via the supply-use flow path 23 that has been opened by supplying the ink from the buffer tank 14 in which the ink is stored to the first liquid chamber 46; and the system controller 64 that performs control to supply the ink to the first liquid chamber 46 such that the first liquid chamber 46 is filled with the ink in a state where the supply-use flow path 23 is closed, hold a state where the first elastic film 44 is caused to press against the inner wall of the first gas chamber 48, thereafter open the supply-use path 23 to cause the first elastic film 44 to move from the state where the first elastic film 44 is caused to press against the inner wall of the first gas chamber 48 to a state where pressing is released, and supply, with the first pump 24, the ink from the buffer tank 14 to the head 112 via the supply-use tank 40 and the supply-use flow path 23. In this configuration, the inkjet recording apparatus 110 supplies the ink to the head 112 utilizing the elastic returning force by which the first elastic film 44 is moved from the first gas chamber 48 side to the first liquid chamber 46 side, and the inkjet recording apparatus 110 supplies, with the first pump 24, the ink to the head 112. Thus, inkjet recording apparatus 110 can instantaneously raise the pressure and supply the ink to the head 112 at a faster flow velocity in comparison to a case where the ink is supplied to the head 112 by only the first pump 24, and thereafter the inkjet recording apparatus 110 can maintain the raised pressure because the first elastic film 44 moves even more so that a lot of ink can be supplied to the head 112. Thus, the ability of the inkjet recording apparatus 110 to discharge air bubbles and contaminants included in the ink can be improved.

The invention has been described above using the preceding embodiments, but the technical scope of the invention is not limited to the scope described in the preceding embodiments. Various changes or improvements can be made to the preceding embodiments within a scope that does not depart from the gist of the invention, and embodiments to which such changes or improvements have been made are also included in the technical scope of the invention.

Further, the preceding embodiments are not intended to limit the inventions set forth in the claims, and not all combinations of features described in the preceding embodiments are necessary for the solving means of the invention. Various stages of inventions are included in the preceding embodiments, and various inventions can be extracted by combinations of the plural configural requirements disclosed depending on the situation. Even if several configural requirements are deleted from all of the configural requirements described in the preceding embodiments, configurations from which those several components have been deleted may also be extracted as inventions as long as effects are obtained.

Figure 12A:
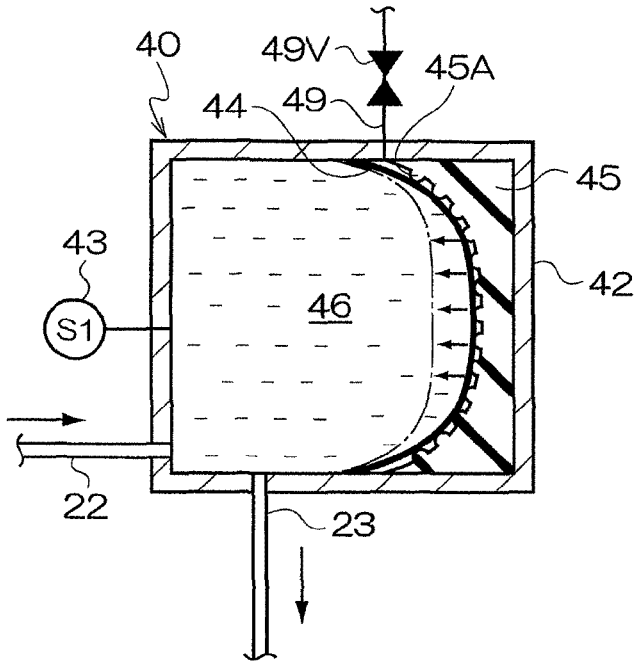
FIG. 12A and FIG. 12B are diagrams showing modifications of the configuration of the supply-use tank pertaining to the embodiments.
Figure 12B:
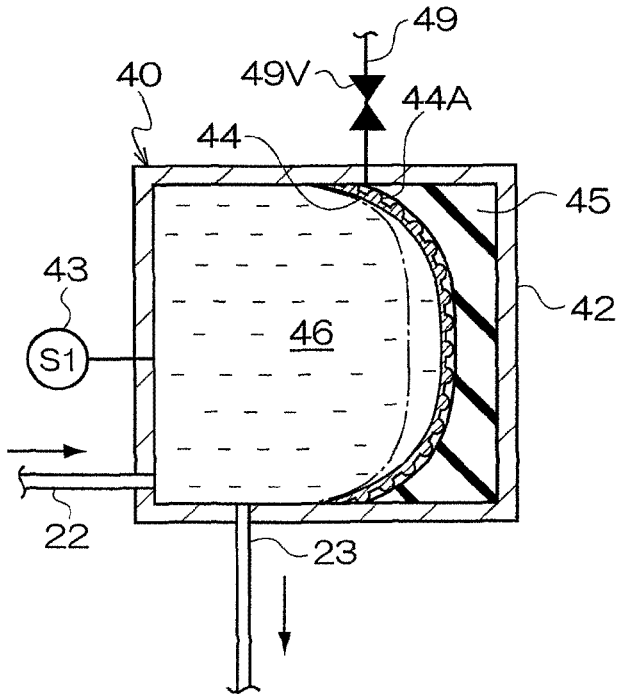
Figure 13:
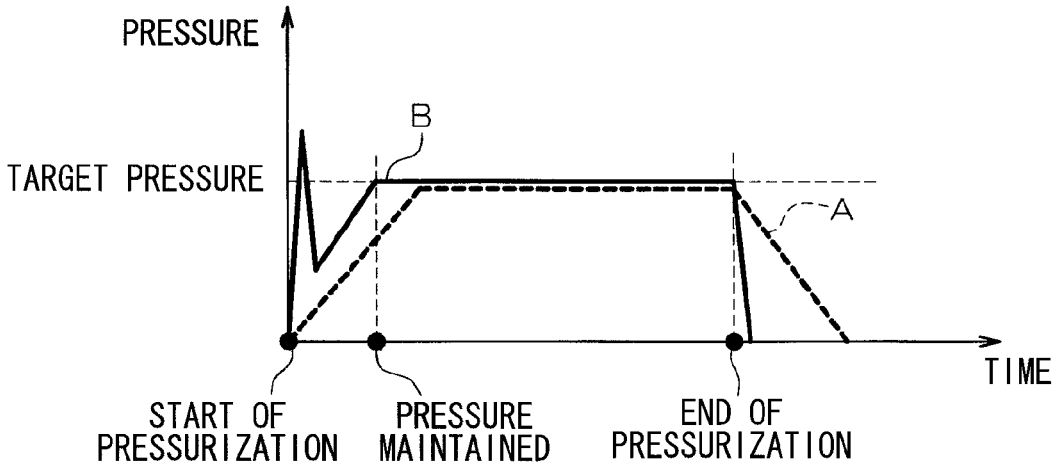
FIG. 13 is a diagram showing changes in pressure acting on a recording head when air bubbles and contaminants included in ink inside a flow path are discharged from nozzles of the recording head using a conventional technology.

For example, in the preceding embodiments, it is conceivable for the first elastic film 44 to become tightly adhered to the first elastic member 45 during the pressurized discharge processing such that the first elastic film 44 and the first elastic member 45 stick to each other and smooth movement of the first elastic film 44 is inhibited. Thus, as shown in FIG. 12A, the invention may also be configured such that plural projections 45A are formed on the surface of the first elastic member 45 to control sticking together of the first elastic film 44 and the first elastic member 45 or such that, as shown in FIG. 12B, plural projections 44A are formed on the surface of the first elastic film 44 to control sticking together of the first elastic film 44 and the first elastic member 45.

Further, in the preceding embodiments, the three supply-use valves V1A are opened during pressurized discharge, but the invention is not limited to this and may also be configured such that the three supply-use valves V1A are selectively opened in accordance with an instruction from the system controller 64. Further, it suffices as long as one of the supply-use valves V1A is disposed with respect to each of the head bars 112A configuring the head 112, and it suffices as long as the supply-use valve V1A is disposed in a number corresponding to the number of the head bars 112A.

Further, in the second embodiment, the recovery-use tank 50 is disposed between the head 112 and the buffer tank 14, but the recovery-use tank 50 is not invariably necessary, and the ink may also be delivered directly to the buffer tank 14 from the head 112.

Further, in the preceding embodiments, the inkjet recording apparatus 110 has been described as an example, but the invention is not limited to this and can also be applied to image forming apparatus that use a liquid such as a liquid toner or a processing liquid to form an image. A processing liquid is a colorless or pale liquid including polyvalent metals or the like and has the action of causing pigments of inks of the respective colors of Y, M, C and K to agglutinate to reduce running of dots. By dropping this processing liquid onto inks of the respective colors, there is less running of dots and image quality can be improved. Further, by causing the processing liquid to react with the inks, the color gamut (concentration and color saturation) can be expanded, and, as a result, image quality can be improved even more.

Further, the configuration of the inkjet recording apparatus 110 described in the preceding embodiments (see FIG. 1 to FIG. 4) is only an example and, it goes without saying, is capable of being changed depending on the situation within a range that does not depart from the gist of the invention.

Further, the flows of processing by the programs described in the preceding embodiments (see FIG. 5 and FIG. 11) are also only examples, and it goes without saying that unnecessary steps can be deleted, new steps can be added, and the processing order can be switched within a range that does not depart from the gist of the invention.

What is claimed is:

1. A liquid droplet ejecting apparatus comprising:

a recording head that ejects liquid droplets onto a recording medium to record an image;

a supply-use tank whose inside is sectioned by a first elastic film capable of elastic deformation into a liquid chamber that stores a liquid for image recording to be supplied to the recording head and a gas chamber that is filled with a gas;

a supply-use flow path that is capable of being opened and closed and interconnects the supply-use tank and the recording head such that the liquid is capable of circulating therethrough;

a first pump that pumps the liquid stored in the liquid chamber of the supply-use tank to the recording head via the supply-use flow path that has been opened by supplying the liquid from an external tank in which the liquid is stored to the liquid chamber of the supply-use tank;

a control unit that controls of the flow path to:

supply the liquid to the liquid chamber such that the liquid chamber is filled with the liquid in a state where the supply-use flow path is closed, hold the first elastic film in a state where the first elastic film is caused to press against an inner wall of the gas chamber, thereafter open the supply-use flow path to cause the first elastic film to move from the state where the elastic film is caused to press against the inner wall of the gas chamber to a state where pressing is released, and supply, with the first pump, the liquid from the external tank to the recording head via the supply-use tank and the supply-use flow path; and a first elastic member that configures the inner wall of the gas chamber, is disposed in a position in the gas chamber that faces the first elastic film, and is capable of elastic deformation when pressed by the first elastic film from the liquid chamber side.

2. The liquid droplet ejecting apparatus according to claim 1, wherein the first elastic member has a shape that accepts the first elastic film, along which the first elastic film elastically deforms when the first elastic film is pressed against the first elastic member.

3. The liquid droplet ejecting apparatus according to claim 1, wherein the liquid droplet ejecting apparatus holds the state where the first elastic film is caused to press against the inner wall of the gas chamber of the supply-use tank by sealing off the gas chamber of the supply-use tank when the pressure inside the liquid chamber of the supply-use tank is made larger than the pressure inside the gas chamber of the supply-use tank to cause the first elastic film to press against the inner wall of the gas chamber of the supply-use tank by supplying, with the first pump, the liquid from the external tank to the liquid chamber of the supply-use tank in a state where the supply-use flow path is closed and the gas chamber of the supply-use tank is open to the atmosphere.

4. The liquid droplet ejecting apparatus according to claim 1, wherein the recording head comprises a plurality of modules, each of which includes an ejection opening that ejects liquid droplets, the supply-use flow path is individually disposed with respect to each of the plurality of modules, and an opening/closing element capable of being selectively opened and closed is disposed in each of the supply-use flow paths.

5. The liquid droplet ejecting apparatus according to claim 1, wherein the first elastic film includes a plurality of projections on its surface.

6. The liquid droplet ejecting apparatus according to claim 1, wherein the first elastic member includes a plurality of projections on its surface.

7. The liquid droplet ejecting apparatus according to claim 1, wherein the liquid pumped to the recording head is ejected via a plurality of nozzles of the recording head.

8. A liquid droplet ejecting apparatus comprising:

a recording head that ejects liquid droplets onto a recording medium to record an image, a supply-use tank whose inside is sectioned by a first elastic film capable of elastic deformation into a liquid chamber that stores a liquid for image recording to be supplied to the recording head and a gas chamber that is filled with a gas, a supply-use flow path that is capable of being opened and closed and interconnects the supply-use tank and the recording head such that the liquid is capable of circulating therethrough, a first pump that pumps the liquid stored in the liquid chamber of the supply-use tank to the recording head via the supply-use flow path that has been opened by supplying the liquid from an external tank in which the liquid is stored to the liquid chamber of the supply-use tank, a control unit that controls of the flow path to:

supply the liquid to the liquid chamber such that the liquid chamber is filled with the liquid in a state where the supply-use flow path is closed, hold the first elastic film in a state where the first elastic film is caused to press against an inner wall of the gas chamber, thereafter open the supply-use flow path to cause the first elastic film to move from the state where the elastic film is caused to press against the inner wall of the gas chamber to a state where pressing is released, and supply, with the first pump, the liquid from the external tank to the recording head via the supply-use tank and the supply-use flow path, a recovery-use tank whose inside is sectioned by a second elastic film capable of elastic deformation into a liquid chamber that stores the liquid that has been recovered from the recording head and a gas chamber that is filled with a gas, a recovery-use flow path that is capable of being opened and closed and interconnects the recovery-use tank and the recording head such that the liquid is capable of circulating therethrough, a second pump that includes the function of recovering the liquid from the recording head to the recovery-use tank via the recovery-use flow path and the function of supplying the liquid from the external tank to the recovery-use tank, and a communication path that allows the liquid chamber of the supply-use tank and the liquid chamber of the recovery-use tank to be communicated with each other, wherein the control unit controls to:

supply the liquid to the liquid chamber of the supply-use tank such that the liquid chamber of the supply-use tank is filled with the liquid in a state where the supply-use flow path, the recovery-use flow path and the communication path are closed, hold a state where the first elastic film is caused to press against the inner wall of the gas chamber of the supply-use tank, supply the liquid to the liquid chamber of the recovery-use tank such that the liquid chamber of the recovery-use tank is filled with the liquid, hold a state where the second elastic film is caused to press against an inner wall of the gas chamber of the recovery-use tank, thereafter open the supply-use path and the communication path, while holding the state where the first elastic film is caused to press against the inner wall of the gas chamber of the supply-use tank, to cause the second elastic film to move from the state where the second elastic film is caused to press against the inner wall of the gas chamber of the recovery-use tank to a state where pressing is released, and supply, with the second pump, the liquid from the external tank to the recording head via the recovery-use tank, the communication path, the supply-use tank and the supply-use path.

9. The liquid droplet ejecting apparatus according to claim 8, wherein the liquid droplet ejecting apparatus holds the state where the second elastic film is caused to press against the inner wall of the gas chamber of the recovery-use tank by sealing off the gas chamber of the recovery-use tank when the pressure inside the liquid chamber of the recovery-use tank is made larger than the pressure inside the gas chamber of the recovery-use tank to cause the second elastic film to press against the inner wall of the gas chamber of the recovery-use tank by supplying, with the second pump, the liquid from the external tank to the liquid chamber of the recovery-use tank in a state where the recovery-use flow path and the communication path are closed and the gas chamber of the recovery-use tank is open to the atmosphere.

10. The liquid droplet ejecting apparatus according to claim 8, wherein the control unit performs control such that the liquid is supplied by the second pump from the external tank to the recording tank via the recovery-use tank, the communication path, the supply-use tank and the supply-use flow path, and thereafter the control unit performs control to close the communication path, while holding the state where the first elastic film is caused to press against the inner wall of the gas chamber of the supply-use tank, such that the liquid is supplied by the first pump from the external tank to the recording head via the supply-use tank and the supply-use flow path.

11. The liquid droplet ejecting apparatus according to claim 10, wherein the control unit performs control to cause the first pump to supply the liquid to the recording head for a predetermined amount of time and thereafter release the state where the first elastic film is caused to press against the inner wall of the gas chamber of the supply-use tank.

12. The liquid droplet ejecting apparatus according to claim 8, further comprising a second elastic member that configures the inner wall of the gas chamber of the recovery-use tank, is disposed in a position in the gas chamber of the recovery-use tank that faces the second elastic film, and is capable of elastic deformation when pressed by the second elastic film from the liquid chamber side of the recovery-use tank.

13. The liquid droplet ejecting apparatus according to claim 12, wherein the second elastic member has a shape that accepts the second elastic film, along which the second elastic film elastically deforms when the second elastic film is pressed against the second elastic member.

14. A method of controlling a liquid droplet ejecting apparatus equipped with a recording head that ejects liquid droplets onto a recording medium to record an image, a supply-use tank whose inside is sectioned by an elastic film capable of elastic deformation into a liquid chamber that stores a liquid for image recording and a gas chamber that is filled with a gas, a first elastic member that configures the inner wall of the gas chamber, that is disposed in a position in the gas chamber that faces the first elastic film, and is capable of elastic deformation when pressed by the first elastic film from the liquid chamber side, a supply-use flow path that is capable of being opened and closed and interconnects the supply-use tank and the recording head such that the liquid is capable of circulating therethrough, and a pump that supplies the liquid to the supply-use tank, the method comprising:

supplying the liquid to the liquid chamber such that the liquid chamber is filled with the liquid in a state where the supply-use flow path is closed;

holding the elastic film in a state where the elastic film is caused to press against an inner wall of the gas chamber;

opening the supply-use flow path to cause the elastic film to move from the state where the elastic film is caused to press against the inner wall of the gas chamber to a state where pressing is released; and supplying, with the pump, the liquid from an external tank to the liquid chamber of the supply-use tank to thereby supply the liquid to the recording head via the supply-use flow path.

15. A method of controlling a liquid droplet ejecting apparatus comprising the following (A) through (E):

(A) providing a liquid droplet ejecting apparatus comprising:

a recording head that ejects liquid droplets onto a recording medium to record an image;

a supply-use tank whose inside is sectioned by a first elastic film capable of elastic deformation into a liquid chamber that stores a liquid for image recording to be supplied to the recording head and a gas chamber that is filled with a gas;

a supply-use flow path that is capable of being opened and closed and interconnects the supply-use tank and the recording head such that the liquid is capable of circulating therethrough;

a first pump that pumps the liquid stored in the liquid chamber of the supply-use tank to the recording head via the supply-use flow path that has been opened by supplying the liquid from an external tank in which the liquid is stored to the liquid chamber of the supply-use tank;

a control unit that controls of the flow path to:

supply the liquid to the liquid chamber such that the liquid chamber is filled with the liquid in a state where the supply-use flow path is closed, hold the first elastic film in a state where the first elastic film is caused to press against an inner wall of the gas chamber, thereafter open the supply-use flow path to cause the first elastic film to move from the state where the elastic film is caused to press against the inner wall of the gas chamber to a state where pressing is released, and supply, with the first pump, the liquid from the external tank to the recording head via the supply-use tank and the supply-use flow path, a recovery-use tank whose inside is sectioned by a second elastic film capable of elastic deformation into a liquid chamber that stores the liquid that has been recovered from the recording head and a gas chamber that is filled with a gas, a recovery-use flow path that is capable of being opened and closed and interconnects the recovery-use tank and the recording head such that the liquid is capable of circulating therethrough, a second pump that includes the function of recovering the liquid from the recording head to the recovery-use tank via the recovery-use flow path and the function of supplying the liquid from the external tank to the recovery-use tank, and a communication path that allows the liquid chamber of the supply-use tank and the liquid chamber of the recovery-use tank to be communicated with each other, wherein the control unit controls to:

supply the liquid to the liquid chamber of the supply-use tank such that the liquid chamber of the supply-use tank is filled with the liquid in a state where the supply-use flow path, the recovery-use flow path and the communication path are closed, hold a state where the first elastic film is caused to press against the inner wall of the gas chamber of the supply-use tank, supply the liquid to the liquid chamber of the recovery-use tank such that the liquid chamber of the recovery-use tank is filled with the liquid, hold a state where the second elastic film is caused to press against an inner wall of the gas chamber of the recovery-use tank, thereafter open the supply-use path and the communication path, while holding the state where the first elastic film is caused to press against the inner wall of the gas chamber of the supply-use tank, to cause the second elastic film to move from the state where the second elastic film is caused to press against the inner wall of the gas chamber of the recovery-use tank to a state where pressing is released, and supply, with the second pump, the liquid from the external tank to the recording head via the recovery-use tank, the communication path, the supply-use tank and the supply-use path, (B) supplying the liquid to the liquid chamber such that the liquid chamber is filled with the liquid in a state where the supply-use flow path is closed;

(C) holding the elastic film in a state where the elastic film is caused to press against an inner wall of the gas chamber;

(D) opening the supply-use flow path to cause the elastic film to move from the state where the elastic film is caused to press against the inner wall of the gas chamber to a state where pressing is released; and (E) supplying, with the first pump, the liquid from an external tank to the liquid chamber of the supply-use tank to thereby supply the liquid to the recording head via the supply-use flow path.

* * * * *